US012313077B2

(12) United States Patent
Lee et al.

(10) Patent No.: US 12,313,077 B2
(45) Date of Patent: May 27, 2025

(54) BLOWER HAVING A MOVABLE AIR FLOW CONVERTER

(71) Applicant: LG ELECTRONICS INC., Seoul (KR)

(72) Inventors: Kunyoung Lee, Seoul (KR); Keunman Park, Seoul (KR); Bohyun Kim, Seoul (KR); Myungjin Ku, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/375,653

(22) Filed: Oct. 2, 2023

(65) Prior Publication Data

US 2024/0026890 A1 Jan. 25, 2024

Related U.S. Application Data

(63) Continuation of application No. 17/898,575, filed on Aug. 30, 2022, now Pat. No. 11,808,275.

(30) Foreign Application Priority Data

Sep. 3, 2021 (KR) ..... 10-2021-0117647

(51) Int. Cl.
*F04D 25/08* (2006.01)
*F04D 25/06* (2006.01)
(Continued)

(52) U.S. Cl.
CPC ..... *F04D 25/08* (2013.01); *F04D 25/06* (2013.01); *F04D 25/10* (2013.01); *F04D 29/462* (2013.01);
(Continued)

(58) Field of Classification Search
CPC ..... F04D 25/10; F04D 29/563; F04D 29/524; F04F 5/16; F04F 5/466; F24F 13/10; F24F 1/0014
See application file for complete search history.

(56) References Cited

U.S. PATENT DOCUMENTS 6,415,622 B2 7/2002 Kim
10,184,495 B2 * 1/2019 Iyer ..... F04D 29/5826
(Continued)

FOREIGN PATENT DOCUMENTS

CN 101231026 7/2008
CN 203453146 U * 2/2014
(Continued)

OTHER PUBLICATIONS

English translation of CN-106642311-A (Year: 2017).*
(Continued)

*Primary Examiner* — Sabbir Hasan
*Assistant Examiner* — Wesley Le Fisher
(74) *Attorney, Agent, or Firm* — KED & ASSOCIATES, LLP

(57) ABSTRACT

A blower includes a lower case provided with an inlet; a first tower that extends upward from the lower case and is formed with a first outlet; a second tower that extends upward from the lower case and is provided with a second outlet; a fan that is rotatably disposed on the lower case; a first air flow converter that is disposed at the first tower; and a second air flow converter that is disposed at the second tower, each of the first air flow converter and the second air flow converter including: a guide board that is disposed inside the first tower or the second tower or protrudes through a first wall or a second wall; an upper gear that rotates in engagement with an upper portion of the guide board; a lower gear that rotates in engagement with a lower portion of the guide
(Continued)

board; a shaft that is connected to each of the upper gear and the lower gear to rotate together; and a motor that is connected to one of the upper gear and the lower gear to provide a driving force.

33 Claims, 22 Drawing Sheets

(51) Int. Cl.

| | |
|---|---|
| ***F04D 25/10*** | (2006.01) |
| ***F04D 29/46*** | (2006.01) |
| ***F04F 5/16*** | (2006.01) |
| ***F24F 1/0014*** | (2019.01) |
| ***F24F 13/12*** | (2006.01) |
| ***F24F 13/20*** | (2006.01) |

(52) U.S. Cl.
CPC ..... *F04F 5/16* (2013.01); *F24F 13/12* (2013.01); *F24F 1/0014* (2013.01); *F24F 13/20* (2013.01); *F24F 2221/28* (2013.01)

(56) References Cited

U.S. PATENT DOCUMENTS

| | | | | |
|---|---|---|---|---|
| 10,969,122 | B2 | 4/2021 | Kim | |
| 11,326,612 | B2 * | 5/2022 | De' Longhi | F04D 25/10 |
| 2012/0051884 | A1 | 3/2012 | Junkel | |
| 2019/0170162 | A1 * | 6/2019 | Jennings | F04D 19/002 |
| 2022/0074419 | A1 | 3/2022 | Pouget | |
| 2022/0145901 | A1 * | 5/2022 | Cai | F04D 29/424 |
| 2022/0228759 | A1 * | 7/2022 | Varma | F04F 5/466 |

FOREIGN PATENT DOCUMENTS

| | | | | |
|---|---|---|---|---|
| CN | 104848508 | | 8/2015 | |
| CN | 105042695 | | 11/2015 | |
| CN | 106642311 | | 5/2017 | |
| CN | 106642311 | A * | 5/2017 | F24F 1/0014 |
| CN | 106705212 | | 5/2017 | |
| CN | 206247479 | | 6/2017 | |
| CN | 206877265 | | 1/2018 | |
| CN | 206877265 | U * | 1/2018 | |
| CN | 209083703 | | 7/2019 | |
| CN | 110701676 | | 1/2020 | |
| JP | 2015-152005 | | 8/2015 | |
| JP | 2019-060294 | | 4/2019 | |
| KR | 10-2008-0010683 | | 1/2008 | |
| KR | 10-2011-0099318 | | 9/2011 | |
| KR | 10-2011-0100274 | | 9/2011 | |
| KR | 10-1516364 | | 5/2015 | |
| KR | 2015-0144354 | | 12/2015 | |
| KR | 10-2019-0015325 | | 2/2019 | |
| KR | 10-2019-0025443 | | 3/2019 | |
| KR | 10-2020-0043737 | | 4/2020 | |
| KR | 10-2020-0089362 | | 7/2020 | |
| WO | WO-2017069437 | A1 * | 4/2017 | F24F 1/00 |
| WO | WO 2021/107696 | | 6/2021 | |

OTHER PUBLICATIONS

English translation of CN-203453146-U (Year: 2014).*
English translation of CN-206877265-U (Year: 2018).*
English translation of WO-2017069437-A1 (Year: 2017).*
Extended European Search Report dated Jan. 24, 2023 issued in Application No. 22193201.5.
Korean Notice of Allowance dated May 26, 2023 issued in Application No. 10-2021-0117647.
U.S. Office Action dated Feb. 2, 2023 issued in U.S. Appl. No. 17/898,575.
U.S. Office Action dated Jul. 5, 2023 issued in U.S. Appl. No. 17/898,575.
English translation of CN209083703U (Year: 2019).
English translation of JP2015152005A (Year: 2015).
English translation of CN106705212A (Year: 2017).
English translation of KR101516364B1 (Year: 2015).
English translation of CN110701676A (Year: 2020).
English translation of KR20150144354A (Year: 2015).
English translation of CN105042695A (Year: 2015).
English translation of CN104848508A (Year: 2015).

* cited by examiner

BLOWER HAVING A MOVABLE AIR FLOW CONVERTER

CROSS-REFERENCE TO RELATED APPLICATION

This application is a continuation of U.S. patent application Ser. No. 17/898,575, filed Aug. 30, 2022, which claims priority under 35 U.S.C. § 119 to Korean Application No. 10-2021-0117647, filed in Korea on Sep. 3, 2021, whose entire disclosure are hereby incorporated by reference.

BACKGROUND

1. Field

The present disclosure relates to a blower. More particularly, the present disclosure relates to a blower capable blowing in different directions.

2. Background

A blower may cause an air flow to circulate air in an indoor space or to form an air flow toward a user to improve comfort. The blower may directly blow air toward a user, but in some cases, it is possible to provide user's comfort through indirect air blowing.

In this regard, Korean Patent Laid-Open Patent Publication Nos. KR2011-0099318, KR2011-0100274, KR2019-0015325, and KR2019-0025443 disclose a type of blower or a fan that blows air using the Coandă effect, which is a tendency of a flow of air or other fluid to travel along a curved surface. The blower disclosed in the these documents directly blow air to a user, but may not provide indirect blowing. In addition, the blower may adjust a blowing direction by changing a position or orientation of the entire blower structure in order to control the output blowing direction. However, a structure for controlling the wind direction by changing the position or orientation of the entire structure of the blower may be difficult to effectively implement, may be have a limited ability to stepwise control the blowing direction, or may cause excessive power consumption.

BRIEF DESCRIPTION OF THE DRAWINGS

Embodiments will be described in detail with reference to the following drawings in which like reference numerals refer to like elements, and wherein.

DETAILED DESCRIPTION

Figure 1:
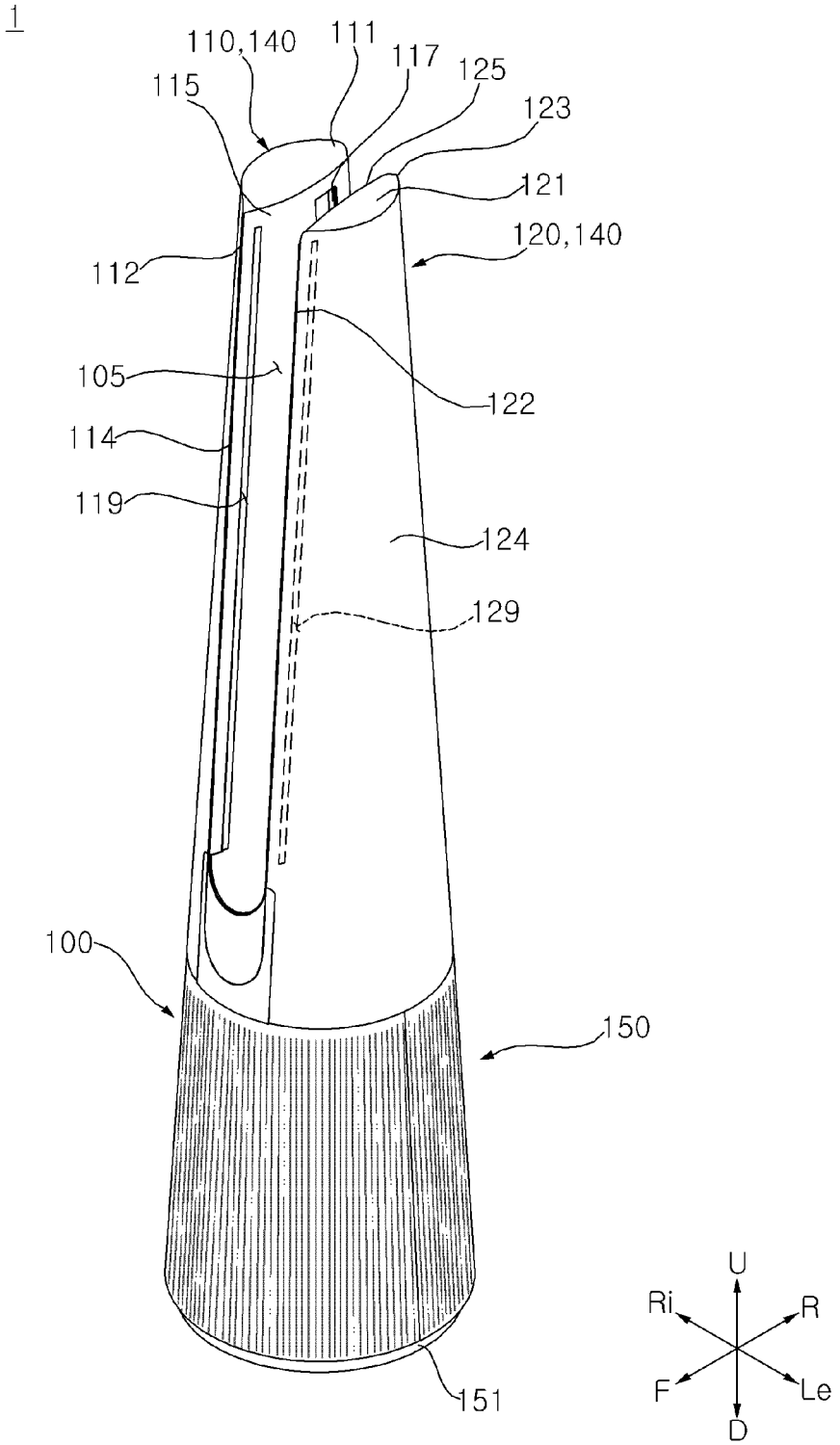
FIG. 1 is a perspective view of a blower according to a first embodiment of the present disclosure.

Various advantages and features of the present disclosure and methods accomplishing them will become apparent from the following description of embodiments with reference to the accompanying drawings. However, the present disclosure is not limited to the embodiments disclosed herein, but will be implemented in various forms. The embodiments make contents of the present disclosure thorough and are provided so that those skilled in the art can easily understand the scope of the present disclosure. Therefore, the present disclosure will be defined by the scope of the appended claims. Throughout the specification, like reference numerals denote like elements.

Hereinafter, the present disclosure will be described with reference to drawings for describing a blower according to embodiments of the present disclosure. Referring to FIGS. 1 to 4, a blower 1 may include a case 100 that provides an appearance of the blower 1. The case 100 may include a lower case 210 in which a filter 200 is installed, and an upper case 140 that discharges air through a Coandă effect.

The upper case 140 may include a first tower 110 and a second tower 120 that are separated in the form of two pillars. The first tower 110 may be disposed on the left, and the second tower 120 may be disposed on the right, relative to a wind output direction.

The first tower 110 and the second tower 120 may be disposed to be spaced apart from each other. A blowing space 105 may be formed between the first tower 110 and the second tower 120. The blowing space 105 may be opened at the front, rear and upper side. The upper case 140 including the first tower, the second tower, and the blowing space is formed in a truncated cone shape.

Outlets 117 and 127 may be disposed in the first tower 110 and the second tower 120, respectively, to discharge air to the blowing space 105. The first outlet 117 may be formed in the first tower 110, and the second outlet 127 may be formed in the second tower 120. Each of the first outlet and the second outlet may be formed in a corresponding one of the first tower 110 and the second tower 120 at a position where the blowing space is formed. The air discharged through the first outlet 117 and/or the second outlet 127 may be discharged in a direction crossing the blowing space 105. An air discharging direction of the air discharged through the first tower 110 and the second tower 120 may be formed in a front-rear direction and an up-down direction.

Figure 2A:
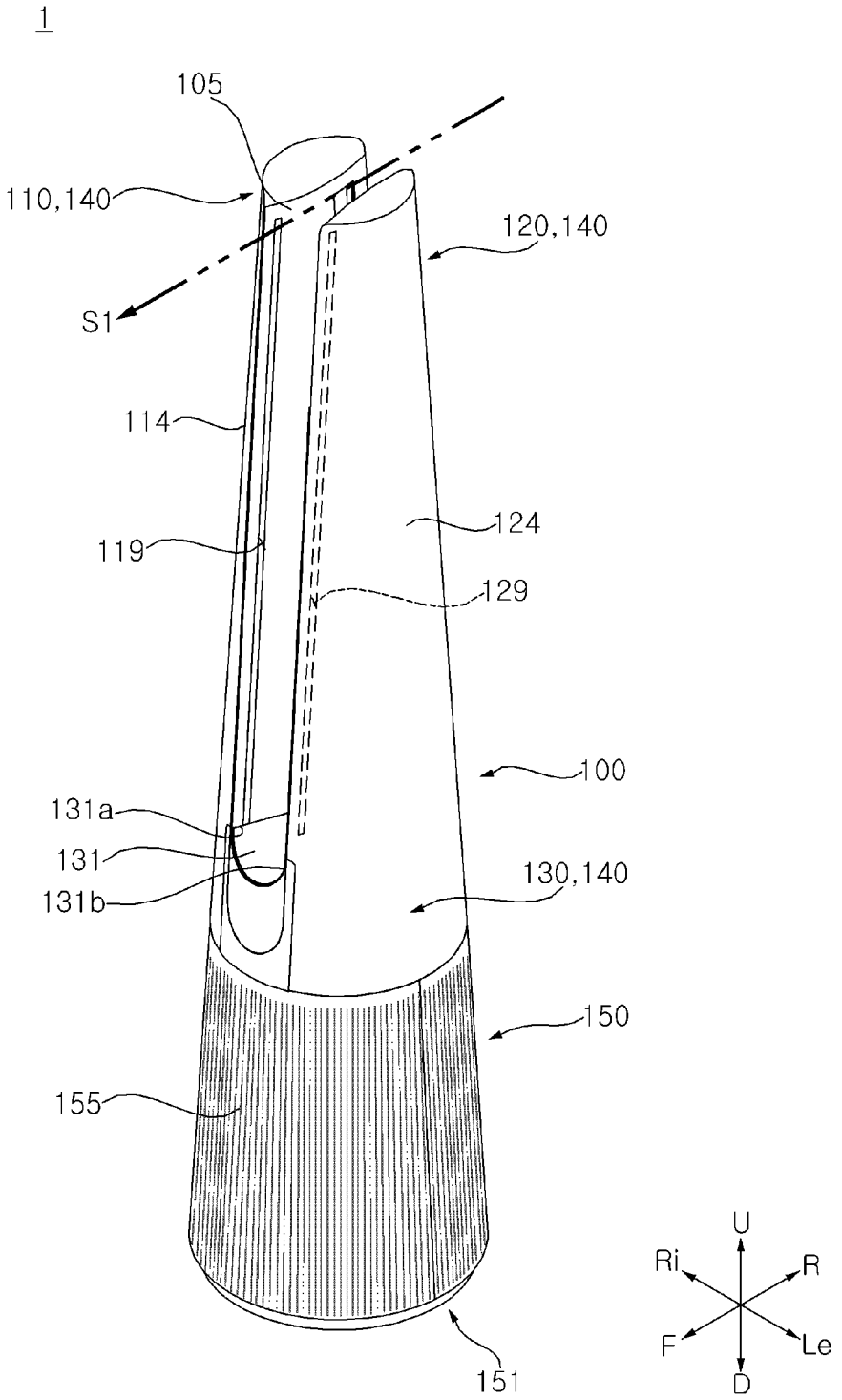
FIG. 2A is an exemplary operation diagram when air is discharged in a first direction from the blower of FIG. 1.

Referring to FIG. 2A, the air discharging direction crossing the blowing space 105 may be formed as a first air discharging direction S1 disposed in the horizontal direction. In addition, referring to FIG. 2B, the air discharging direction crossing the blowing space 105 may be formed as a second air discharging direction S2 formed in the up-down direction. The air flowing in the first air discharging direction S1 may be defined as a horizontal air flow, and the air flowing in the second air discharging direction S2 may be defined as an upward air flow.

The horizontal air flow may mean that a main flow direction of air is in the horizontal direction, and may mean that a flow rate (e.g., a flow volume or intensity) of the air flowing in the horizontal direction is more than that of a flow rate of air flowing in the vertical direction. Similarly, the upward air flow may mean that the main flow direction of air is the upward direction, and mean that the flow rate of the air flowing in the upward direction is formed to be more than that of flow rate of air flowing in the vertical direction.

The blowing space 105 may be formed by the first tower 110 and the second tower 120. The blowing space 105 may be formed as a space between interior surfaces facing each other in the first tower 110 and the second tower 120. The air discharged from the first outlet 117 of the first tower 110 and the air discharged from the second outlet 127 of the second tower 120 may be joined in the blowing space 105, and then, may flow forward and/or upward.

Indirect air flow may be also generated even in the outer walls 114 and 124 due to the formation of a horizontal air flow caused by the Coandă effect generated in the blowing space 105. Referring to FIG. 2A, the air behind the blowing space may also flow into the blowing space by the discharge air discharged to the blowing space 105.

Since the discharge air of the first outlet 117 and the discharge air of the second outlet 127 are joined in the blowing space 105, the straightness of the discharge air may be improved. In addition, by joining the discharge air of the first outlet 117 and the discharge air of the second outlet 127 in the blowing space 105, the air around the first tower 110 and the second tower 120 may indirectly flow in the air discharge direction.

Figure 2B:
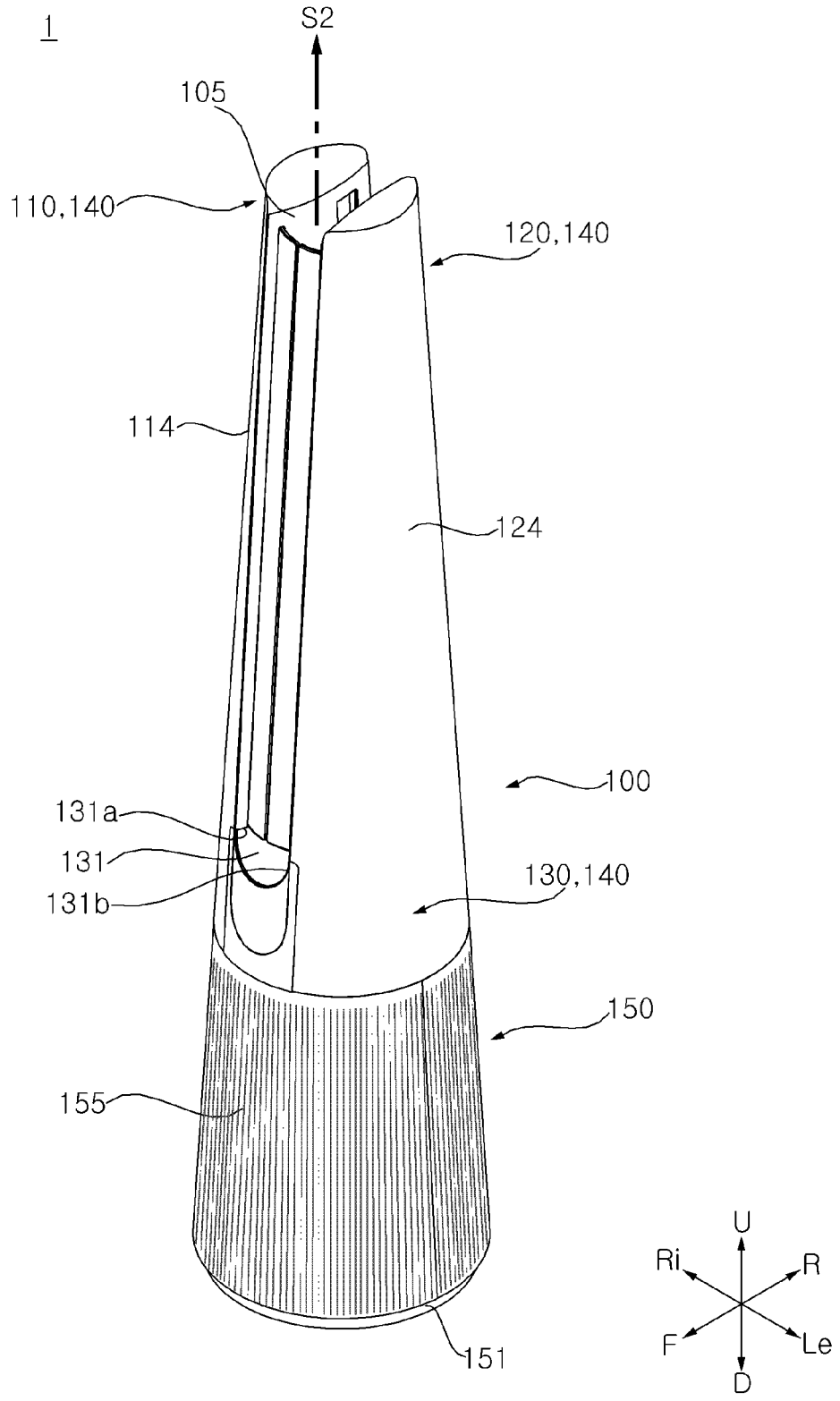
FIG. 2B is an exemplary operation diagram when the air is discharged in a second direction from the blower of FIG. 1.

Referring to FIG. 2A, the first air discharging direction S1 is formed from the rear to the front, and referring to FIG. 2B, the second air discharging direction S2 is formed from the lower side to the upper side. Referring to FIG. 1, an upper side end 111 of the first tower 110 and an upper side end 121 of the second tower 120 may be spaced apart from each other for the second air discharging direction S2. For example, the air discharged in the second air discharging direction S2 may not interfere with the case 100 of the blower 1.

Referring to FIG. 1, for the first air discharging direction S1, the front end 112 of the first tower 110 and the front end 122 of the second tower 120 may be spaced apart from each other, and a rear end 113 of the first tower 110 and a rear end 123 of the second tower 120 may be also spaced apart from each other. A surface facing the blowing space 105 in the first tower 110 and the second tower 120 may be referred to as an inner side surface, and a surface not facing the blowing space 105 may be referred to as an outer side surface.

Figure 4:
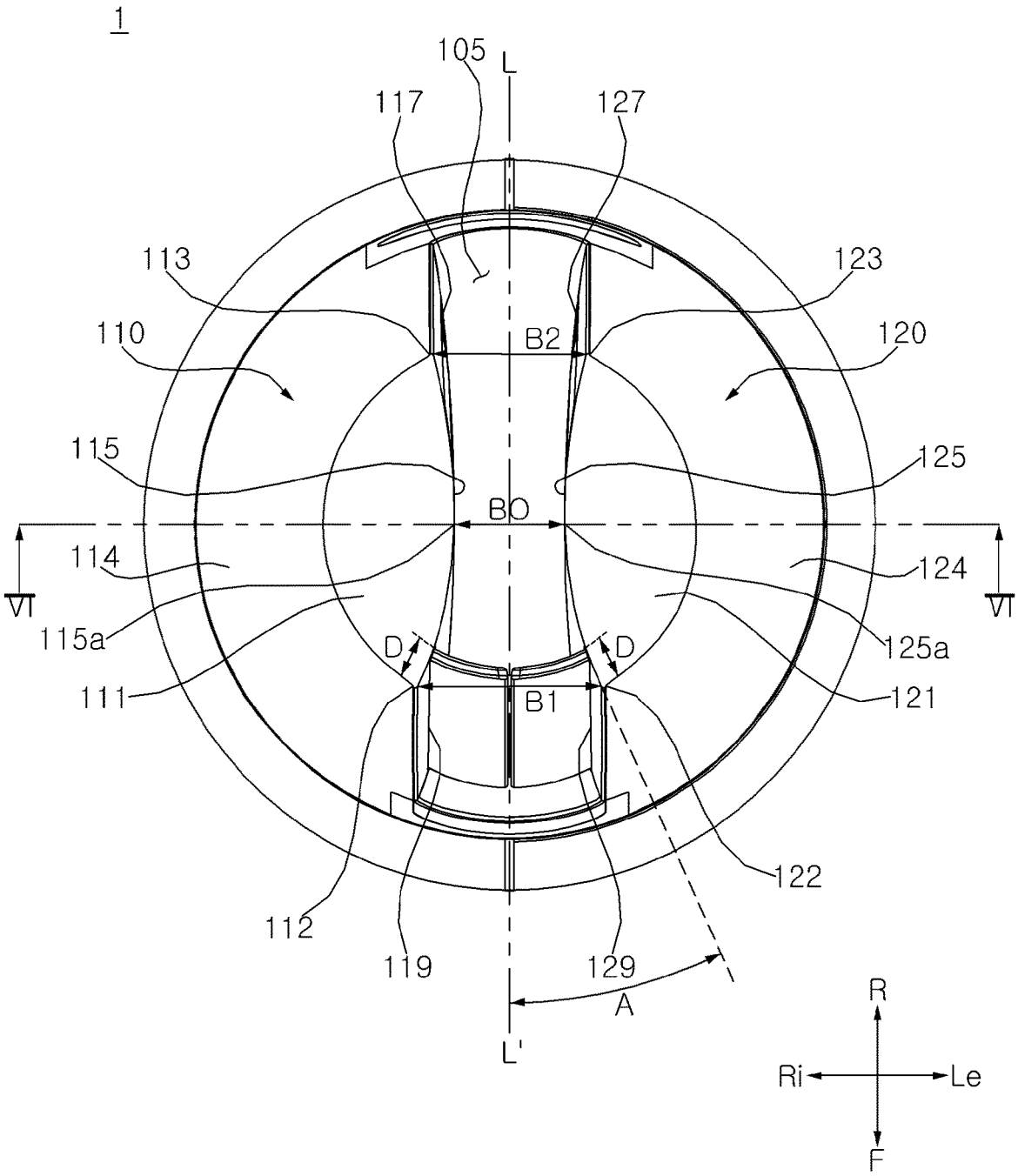
FIG. 4 is a plan view of FIG. 1.

Referring to FIG. 4, an outer side wall 114 of the first tower 110 and an outer side wall 124 of the second tower 120 may be disposed in an opposite direction to each other. An inner side wall (or first wall, 115) of the first tower 110 and an inner side wall (or second wall, 125) of the second tower 120 may be disposed to face each other. The first inner side wall 115 may be formed to protrude toward the second tower, and the second inner side wall 125 may be formed to protrude toward the first tower.

The first tower 110 and the second tower 120 may be formed in a streamlined shape with respect to the flow direction of the air. The first inner side wall 115 and the first outer side wall 114 may be formed in a streamlined shape with respect to the front-rear direction, and the second inner side wall 125 and the second outer side wall 124 may be formed in a streamlined shape with respect to the front-rear direction.

Referring to FIG. 4, the first outlet 117 may be disposed on the first inner side wall 115, and the second outlet 127 may be disposed on the second inner side wall 125. In a central portion 115*a* of the first inner side wall 115 and a central portion 125*a* of the second inner side wall 125, the first inner side wall 115 and the second inner side wall 125 may be spaced apart from each other by the shortest distance B0. The central portion 115*a* of the first inner side wall 115 may be a region located between the front end 112 and the rear end 113 of the first inner side wall 115. Similarly, the central portion 125*a* of the second inner side wall 125 may be a region located between the front end 122 and the rear end 123 of the first inner wall 125.

Each of the first outlet 117 and the second outlet 127 may be disposed behind the central portion 115*a* of the first inner side wall 115 and the central portion 125*a* of the second inner side wall 125. For example, the first outlet 117 may be disposed between the central portion 115*a* and the rear end 113 of the first inner side wall 115. The second outlet 127 may be disposed between the central portion 125*a* and the rear end 123 of the second inner side wall 125.

A separation distance between the first inner side wall 115 and the second inner side wall 125 may increase rearward from the central portion 125*a*. In addition, the separation distance between the first inner side wall 115 and the second inner side wall 125 may increase forward from the central portion 125*a*. For example, the separation distance between the front end 112 of the first tower 110 and the front end 122 of the second tower 120 may be referred to as a first separation distance B1. The separation distance between the rear end 113 of the first tower 110 and the rear end 123 of the second tower 120 may be referred to as a second separation distance B2. The first separation distance B1 and the second separation distance B2 may be formed longer than the shortest distance B0. The first separation distance B1 and the second separation distance B2 may have the same length or may be formed differently. The closer the outlets 117 and 127 are to, respectively, the rear ends 113 and 123, the easier it typically is to control the air flow through the Coandă effect, which will be described later.

The inner side wall 115 of the first tower 110 and the inner side wall 125 of the second tower 120 may directly provide the Coandă effect, and the outer side wall 114 of the first tower 110 and the outer side wall 124 of the second tower 120 may indirectly provide the Coandă effect. The inner side walls 115 and 125 directly guide the air discharged from the outlets 117 and 127 to the front ends 112 and 122. For example, the inner side walls 115 and 125 induce the air discharged from the outlets 117 and 127 to directly provide the horizontal air flow.

The indirect air flow may be also generated in the outer side walls 114 and 124 due to the air flow in the blowing space 105. The outer side walls 114 and 124 may induce the Coandă effect for the indirect air flow, and may guide the indirect air flow to the front ends 112 and 122. The left side of the blowing space may be blocked by the first inner side wall 115, and the right side of the blowing space may be blocked by the second inner side wall 125, but the upper side of the blowing space 105 may be open.

An air flow converter, to be described later, may convert a horizontal air flow passing through the blowing space into an upward air flow, and the upward air flow may flow to the opened upper side of the blowing space. The upward air flow may suppress the discharge air from directly flowing to the user and activate convection of the indoor air. In addition, the width of the discharge air may be adjusted through the flow rate of air joined in the blowing space. By forming the upper and lower lengths of the first outlet 117 and the second outlet 127 longer than the left and right widths B0, B1, and B2 of the blowing space 105, the discharge air of the first outlet 117 and the discharge air of the second outlet 127 may be induced to be joined in the blowing space 105.

Figure 3:
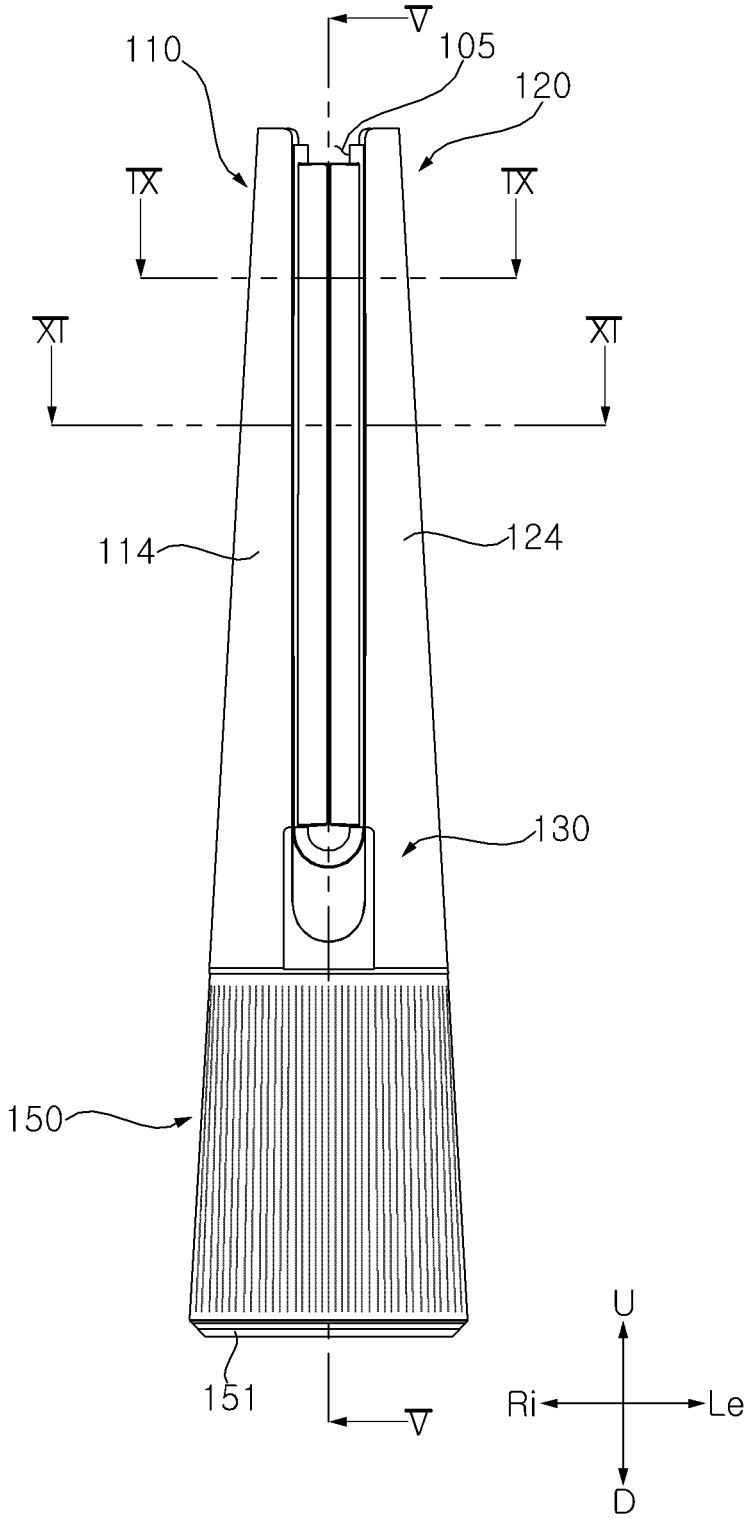
FIG. 3 is a front view of FIG. 1.

Referring to FIGS. 1 to 3, the case 100 of the blower 1 may include a lower case 150 to which a filter is detachably installed, and an upper case 140 supported on the lower case 150. The upper case 140 may include the first tower 110 and the second tower 120. A tower base 130 may connect the first tower 110 and the second tower 120, and the tower base 130 may be assembled to the lower case 150. For example, the tower base 130 may be manufactured integrally with the first tower 110 and the second tower 120. In another example, the first tower 110 and the second tower 120 may be directly assembled to the lower case 150 without the tower base 130, or may be integrally manufactured with the lower case 150.

The lower case 150 may form the lower portion of the blower 1, and the upper case 140 may form the upper portion of the blower 1. The blower 1 may suck ambient air from the lower case 150, and discharge the filtered air from the upper case 140. The upper case 140 may discharge air at a position higher than the lower case 150.

The blower 1 may have a pillar shape in which the diameter decreases toward the upper portion. For example, the blower 1 may have a conical or truncated cone shape as a whole. In another example, the blower 1 may include the two towers arranged therein. In addition, a cross section may not become narrower toward the upper side and instead, the cross section may be consistent or may be become larger in a vertical direction. However, when the cross section becomes narrower toward the upper side as in the present embodiment, the center of gravity of the blower 1 may lowered, and the risk of overturning due to external impact may be reduced.

For the convenience of assembly, in one example, the lower case 150 and the upper case 140 may be separately manufactured. In another example, the lower case 150 and the upper case 140 may be integrally formed. For example, the lower case and the upper case may be assembled after manufacturing in the form of a front case and a rear case integrally manufactured.

The lower case 150 may be formed to gradually decrease in diameter toward the upper end. The upper case 140 is also formed to gradually decrease in diameter toward the upper end. The outer surfaces of the lower case 150 and the upper case 140 may be formed to be reversed. In particular, the lower end of the tower base 130 and the upper end of the lower case 150 may be in close contact, and the outer side surface of the tower base 130 and the outer side surface of the lower case 150 may form a continuous surface. To this end, the diameter of the lower end of the tower base 130 may be formed to be the same as or slightly smaller than that of the upper end of the lower case 150.

The tower base 130 may distribute air supplied from the lower case 150, and provides the distributed air to the first tower 110 and the second tower 120. The tower base 130 may connect the first tower 110 and the second tower 120. The blowing space 105 may be disposed above the tower base 130. In addition, the outlets 117 and 127 may be formed above the tower base 130, and the upward air flow and horizontal air flow may be formed above the tower base 130.

In order to minimize friction with air, an upper side surface 131 of the tower base 130 may be formed as a curved surface. For example, the upper side surface may be formed as a curved surface depressed downward and may be formed to extend in the front-rear direction. Referring to FIGS. 2A and 2B, one side 131*a* of the upper side 131 may be connected to the first inner side wall 115, and the other side 131*b* of the upper side 131 may be is connected to the second inner side wall 125.

When viewed from a top view with reference to FIG. 4, the first tower 110 and the second tower 120 may be symmetrical left and right with respect to a center line L-L'. For example, the first outlet 117 and the second outlet 127 may be formed to be symmetrical left and right with respect to the center line L-L'. The center line L-L' may be an imaginary line between the first tower 110 and the second tower 120, may be formed in the front-rear direction in the present embodiment, and may be formed to pass through the upper side surface 131.

In another example, the first tower 110 and the second tower 120 may be formed in an asymmetrical shape. However, to improve control of the horizontal air flow and the upward air flow, the first tower 110 and the second tower 120 may be symmetrically disposed with respect to the center line L-L'.

Figure 5:
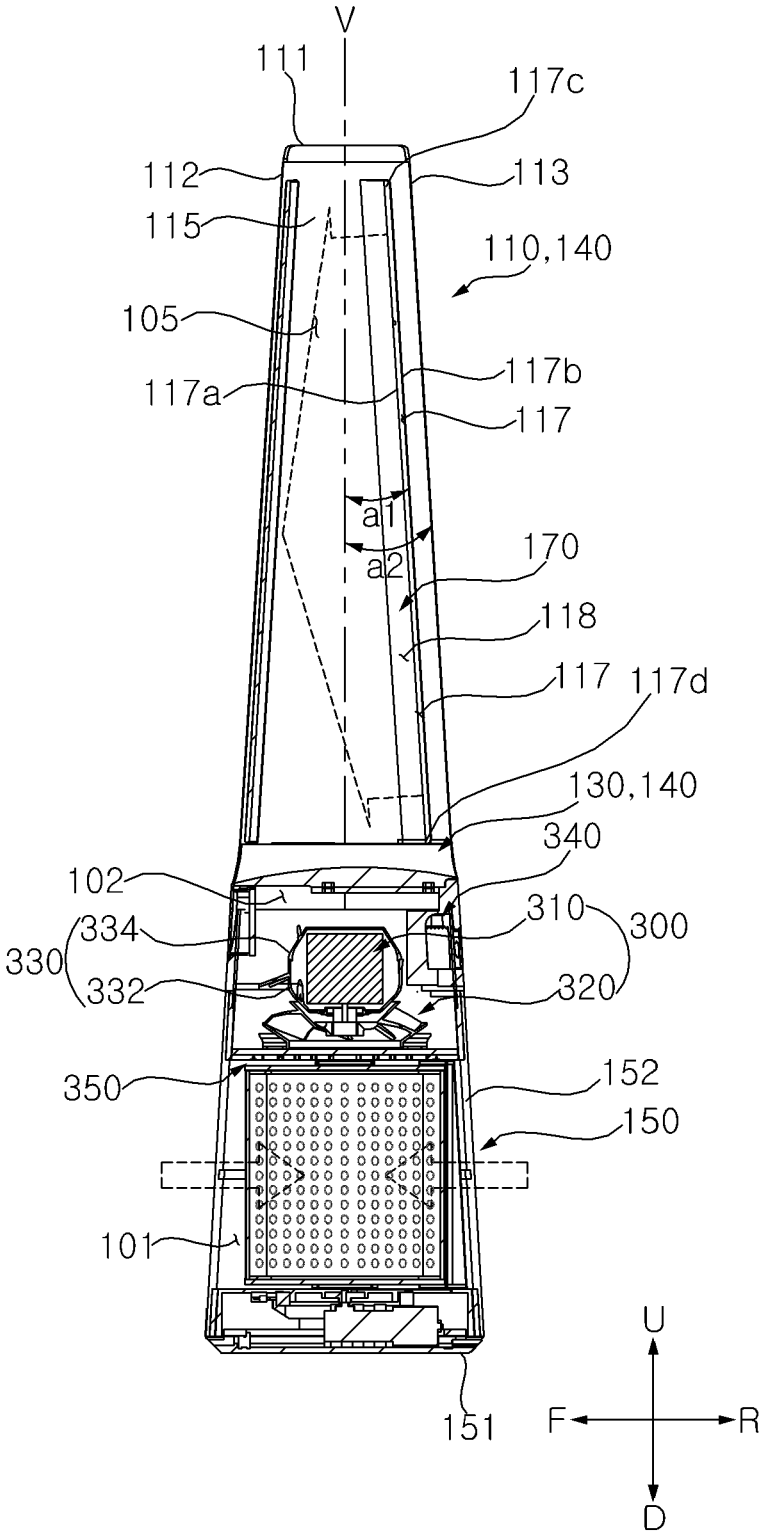
FIG. 5 is a cross-sectional view taken along line V-V of FIG. 3.
Figure 6:
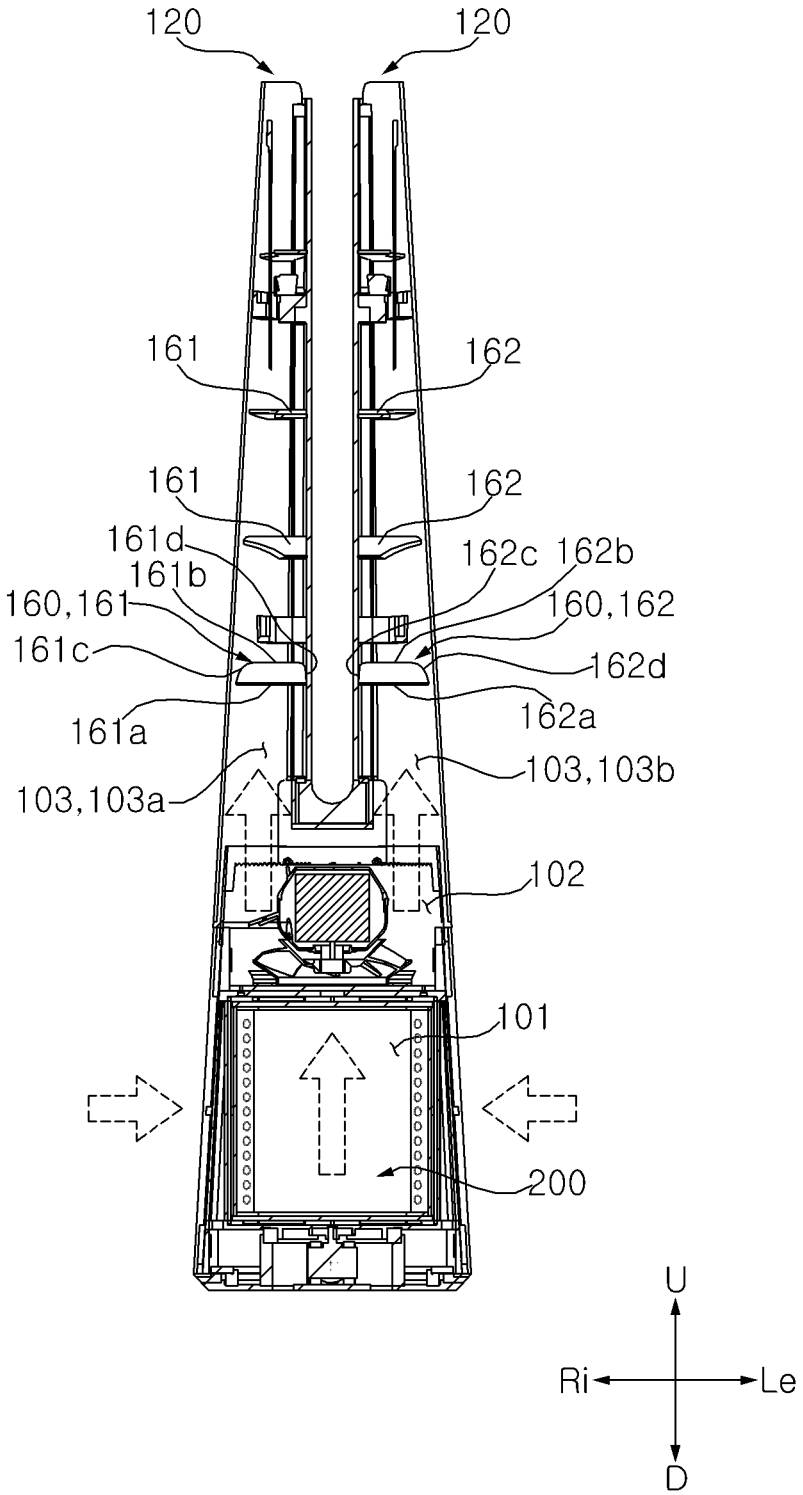
FIG. 6 is a cross-sectional view taken along line VI-VI of FIG. 4.

Referring to FIG. 1, 5, or 6, the blower 1 may include a filter 200 that is disposed inside the filter 200 and a fan device 300 that is disposed inside the case 100 and makes air flow to the outlets 117 and 127. The filter 200 and the fan device 300 may be disposed inside the lower case 150. The lower case may be is formed in a truncated cone shape, and the upper side thereof may be opened.

Referring to FIG. 5, the lower case 150 may be formed in a truncated cone shape, and an upper side thereof may be opened. The blowing unit 200 including the filter 220 and the fan device 300 may be included in the lower case 150 that is disposed to surround the filter 220 and the fan device 300, and a plurality of inlets 150 for communicating the inner and outer sides of the lower case 150 may be formed along a circumferential direction of the lower case 155. A base 151 to be set on the ground may be disposed below the lower case 150. The base 151 may be formed in a circular shape.

The lower case 150 may be formed in a truncated cone shape with upper and lower sides open. The lower case 150 may be manufactured as two separate parts, and the two parts may be assembled to form the truncated cone shape. The lower case 150 may be divided into a first lower case 150*a* provided on one side of the blower 1 and a second lower case 150*b* provided on the other side opposite to the one side. When the first lower case 150*a* and/or the second lower case 150*b* is separated from each other, the filter 200 disposed inside the lower case 150 may be withdrawn.

In the lower case 150, a plurality of inlets 155 may be formed long in the up-down direction are radially spaced apart from each other. In another example, the inlet may be formed in the form of a plurality of holes in the lower case 150.

The filter 200 may be formed in a cylindrical shape having an up-down direction hollow therein. The outer surface of the filter 200 may be disposed to face the inlet 155 formed in the lower case 150. Air flow in the blower may flow through the filter 200 from the outside to the inside, and in this process, foreign substances or harmful gases in the air may be removed by the filter 200.

The fan device 300 may be disposed above the filter 200. The fan device 300 may generate a flow of air that has passed through the filter 200 and toward the first tower 110 and the second tower 120. Referring to FIG. 5, the fan device 300 may include a fan motor 310 and a fan 320 rotating by the fan motor 310, and the fan device 300 may be disposed inside the lower case 150.

The fan motor 310 may be disposed above the fan 320, and a motor shaft of the fan motor 310 may be coupled to the fan 320 disposed at the lower side. A motor housing 330 in which the fan motor 310 is installed may be disposed above the fan 320. The motor housing 330 has a shape that surrounds some or an entirety of the fan motor 310. When the motor housing 330 surrounds the entire fan motor 310, the motor housing 300 may reduce flow resistance with air flowing from the lower side to the upper side. In another example, the motor housing 330 may be formed in a shape that surrounds only the lower portion of the fan motor 310.

The motor housing 330 may include a lower motor housing 332 and an upper motor housing 334. At least one of the lower motor housing 332 or the upper motor housing 334 is coupled to the case 100.

The fan motor 310 may be installed above the lower motor housing 332, and then may be covered with the upper motor housing 334 so that the fan motor 310 may be surrounded. The motor shaft of the fan motor 310 may pass through the lower motor housing 332 and may be assembled to the fan 320 positioned below the fan motor 310.

The fan 320 may include a hub to which the motor shaft of the fan motor is coupled, a shroud spaced apart from the hub, and a plurality of blades connecting the hub and the shroud. The air that has passed through the filter 200 may be sucked into the shroud, and then may flow by being pressurized by the rotating blade. The hub may be disposed above the blade, and the shroud may be disposed below the blade. The hub may be formed in a downwardly concave bowl shape, and the lower side of the lower motor housing 332 may be partially inserted into the hub.

In one example, the fan 320 may be a four-flow fan. The four-flow fan sucks air in the center of the shaft and discharges air in a radial direction, but the discharged air is inclined with respect to an axial direction. As previously described, since the air flow may flow vertically upward from the lower side to the upper side, when air is discharged in a radial direction, a flow loss due to the change in the flow direction may occur. The four-flow fan may minimize the flow loss of air by discharging air upward in the radial direction.

Referring to FIG. 5, the diffuser 340 may be disposed above the upper plate 320. The diffuser 340 may guide the air flow upward by the fan 320. The diffuser 340 may further reduce the radial component in the air flow and enhance the upward direction air flow component.

The motor housing 330 may be disposed between the diffuser 340 and the fan 320. In order to minimize the installation height of the motor housing in the up-down direction, the lower end of the motor housing 330 may be inserted into the fan 320. The lower end of the motor housing 330 may be disposed to overlap the fan 320 in the up-down direction. Also, the upper end of the motor housing 330 may be disposed to be inserted into the diffuser 340. The upper end of the motor housing 330 may be disposed to overlap the diffuser 340 in the up-down direction.

The lower end of the motor housing 330 may be disposed higher than the lower end of the fan 320, and the upper end of the motor housing 330 may be disposed lower than the upper end of the diffuser 340. In order to optimize the installation position of the motor housing 330, the upper side of the motor housing 330 may be disposed inside the tower base 130, and the lower side of the motor housing 330 may be disposed inside the lower case 150. In another example, the motor housing 330 may be disposed inside the tower base 130 or the lower case 150.

Referring to FIG. 5, a suction grill 350 may be disposed inside the lower case 150. When the filter 200 is separated, the suction grill 350 blocks a user from inserting a finger into the fan 320, thereby protecting the user and the fan 320. The filter 200 may be disposed below the suction grill 350, and the fan 320 may be disposed above the suction grill 350. The suction grill 350 may be formed with a plurality of through-holes in the up-down direction so that air can flow.

Referring to FIG. 5, a filter installation space 101 in which the filter 200 is disposed below the suction grill 350 may be formed inside the case 100. Referring to FIG. 5, a ventilation space 102 through which air flows between the suction grill 350 and the outlets 117 and 127 may be formed inside the case 100. Referring to FIG. 6, in the side of the first tower 110 and the second tower 120, an air flow may be formed upward, and a discharge space 103 through which air flows through the first outlet 117 or the second outlet 127 may be formed. Here, the ventilation space 102 may include the discharge space 103.

The air may be introduced into the filter installation space 101 through the inlet 155, and then, the air may be discharged to the outlets 117 and 127 through the ventilation space 102 and the discharge space 103. Referring to FIGS. 5 to 8, the discharge space 103 is provided with at least one air guide 160 for switching the flow direction of air to a horizontal direction. A plurality of air guides 160 may be disposed.

The air guide 160 may be switch the direction of the air flowing vertically in an upward direct to flowing in a horizontal direction. The air guide 160 may guide the air flowing upward to a horizontal direction in which the first outlet 117 or the second outlet 127 is formed.

The air guide 160 may include a first air guide 161 disposed inside the first tower 110 and a second air guide 162 disposed inside the second tower 120. Referring to FIG. 6, when viewed from the front, the first air guide 161 may be coupled to the inner side wall and/or the outer side wall of the first tower 110. The first air guide 161 may have a rear side end 161*b* close to the first outlet 117 and a front side end

161*a* spaced apart from the first tower 110. In order to guide the air flowing downward to the first outlet 117, the first air guide 161 may be formed in a convex curved surface from the lower side to the upper side, and the rear side end 161*b* may be disposed higher than the front side end 161*a*.

Referring to FIG. 6, at least a portion of a left end 161*c* of the first air guide 161 may be in close contact with or coupled to the left wall of the first tower 110. At least a portion of a right end 161*d* of the first air guide 161 may be in close contact with or coupled to the right wall of the first tower 110. Accordingly, the air flowing upward along the discharge space 103 may flow from the rear end to the front end of the first air guide 161.

The second air guide 162 may be symmetrical left and right with respect to the first air guide 161. Accordingly, the configuration and shape of the second air guide 162 may correspond to that of the first air guide 161. It should be appreciated, however, that the first air guide 161 and second air guide 162 may have different shapes, such as to provide different air flows in from the first tower 110 and the second tower 120.

Figure 7:
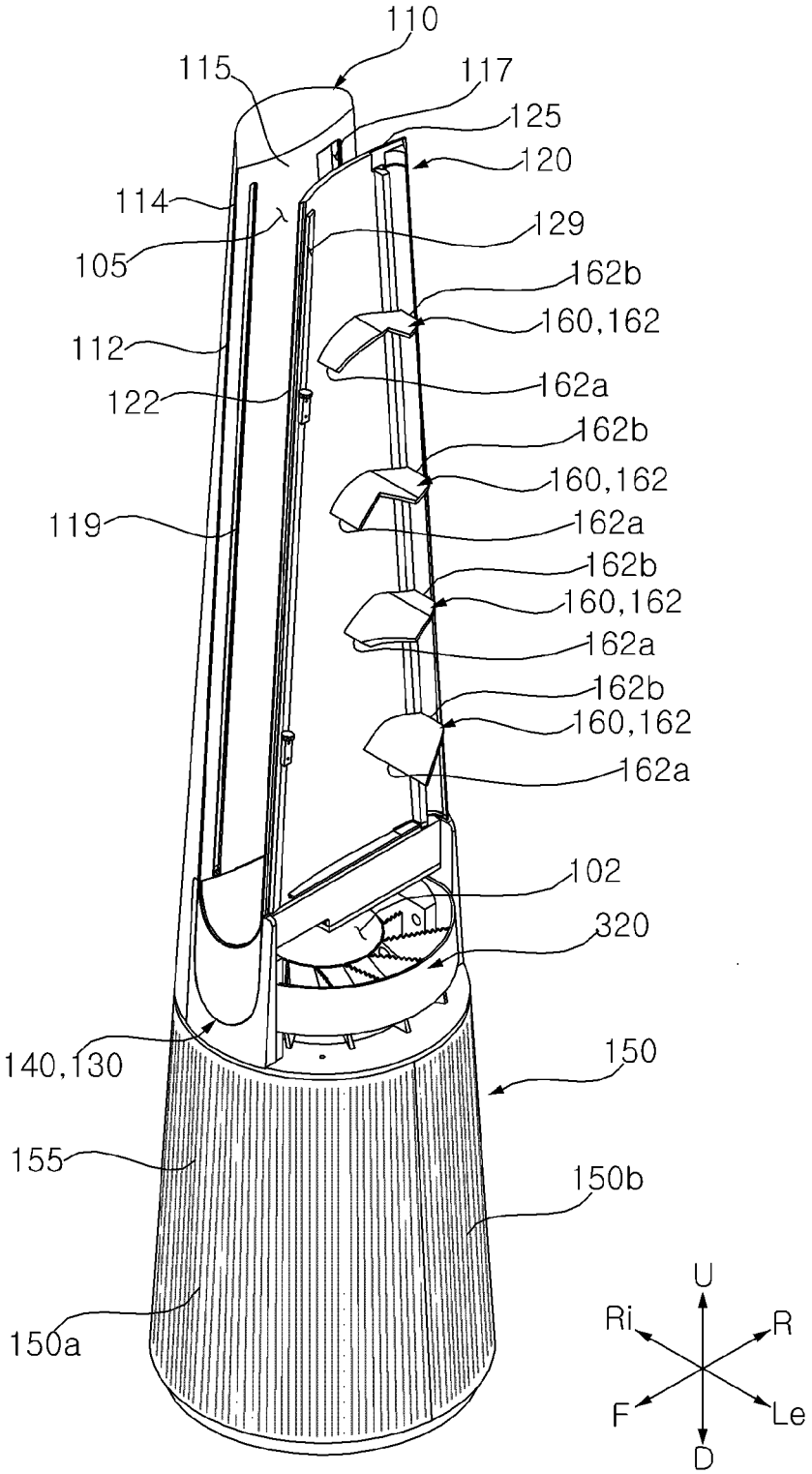
FIG. 7 is a partial exploded perspective view illustrating an inside of a second tower of FIG. 1.
Figure 8:
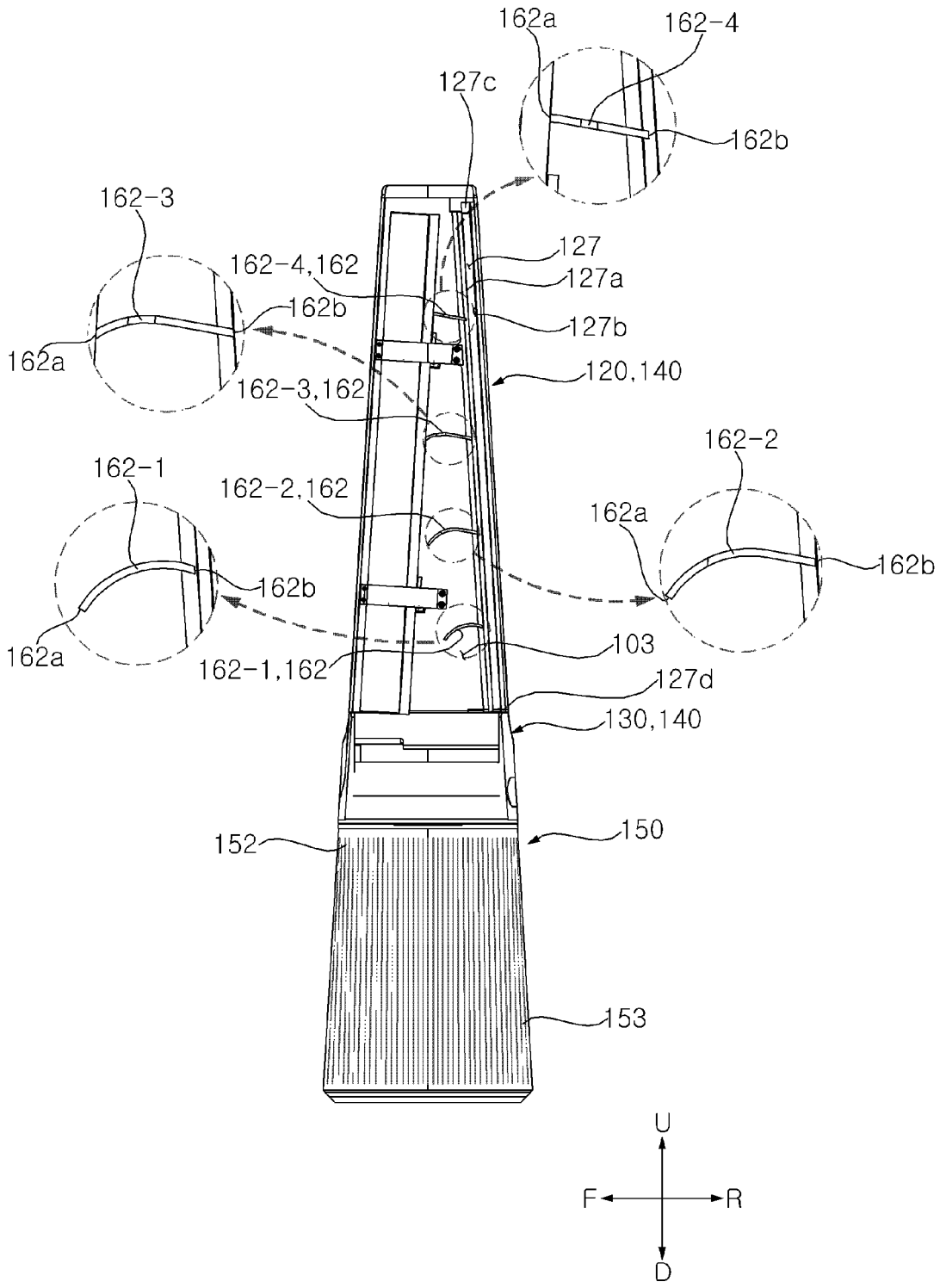
FIG. 8 is a right side view of FIG. 7.

Referring to FIGS. 7 and 8, the second air guide 162 may include a plurality of second air guides 162-1, 162-2, 162-3, and 162-4 in the up-down direction. The second air guide 162 includes a 2-1th air guide 162-1, a 2-2th air guide 162-2, a 2-3th air guide 162-3, and a 2-4th air guide 162-4 that are spaced apart from the lower portion to the upper portion. The plurality of second air guides 162-1, 162-2, 162-3, and 162-4 may be formed so that as they are disposed on the upper side, the ratio of the formed length to the length in the front-rear direction of the inner space of the second tower 120 increases. The plurality of second air guides 162-1, 162-2, 162-3, and 162-4 may have a shape in which the ratio of the curved surfaces formed in the front-rear direction decreases as they are disposed on the upper side.

Referring to FIG. 6, when viewed from the front, the second air guide 162 may be coupled to the inner side wall and/or the outer side wall of the second tower 110. Referring to FIG. 8, the rear side end 162*b* of the second air guide 162 is close to the second outlet 127, and the front side end 162*a* is spaced apart from the rear end of the second tower 120.

In order to guide the air flowing downward to the second outlet 127, the second air guide 162 may be formed in a convex curved surface from the lower side to the upper side, and the rear side end 162*b* may be disposed higher than the front side end 162*a*. Referring to FIG. 6, at least a portion of a left end 162*c* of the second air guide 162 may be in close contact with or coupled to the left wall of the second tower 120. At least a portion of a right end 162*d* of the second air guide 162 may be in close contact with or coupled to the right wall of the first tower 110.

Next, referring to FIG. 5 or 8, the first outlet 117 and the second outlet 127 may be disposed to extend long in an up-down direction. The first outlet 117 may be formed between the front end 112 and the rear end 113 of the first tower 110. The first outlet 117 may be disposed adjacent to the rear end 113 than the front end 112. The air discharged from the first outlet 117 may flow along the first inner side wall 115 by the Coandă effect. The air flowing along the first inner side wall 115 may flow toward the front end 112.

Referring to FIG. 5, the first outlet 117 may include a first border 117*a* that forms an edge on the air discharge side (front end in the present embodiment), a second border 117*b* that forms an edge on a side (rear end in the present embodiment) opposite to the air discharge side, an upper border 117*c* that forms an upper edge of the first outlet 117, and a lower border 117*d* that forms a lower edge of the first outlet 117. Referring to FIG. 5, the first border 117*a* and the second border 117*b* may be disposed parallel to each other. The upper border 117*c* and the lower border 117*d* may be disposed parallel to each other.

Referring to FIG. 5, the first border 117*a* and the second border 117*b* may be disposed to be inclined with respect to a vertical direction V. In addition, the rear end 113 of the first tower 110 may be also inclined with respect to the vertical direction V. An inclination a1 of the outlet 117 may be formed to be larger than an inclination a2 of the outer surface of the tower. Referring to FIG. 5, the inclination a1 of the first border 117*a* and the second border 117*b* with respect to the vertical direction V may be formed at 4°, and the inclination a2 of the rear end 113 may be formed at 3°.

The second outlet 127 may be symmetrical left and right with respect to the first outlet 117. Referring to FIG. 8, the second outlet 127 may include a first border 127*a* that forms an edge on the air discharge side (front end in the present embodiment), a second border 117*b* that forms an edge on a side (rear end in the present embodiment) opposite to the air discharge side, an upper border 127*c* that forms an upper edge of the second outlet 127, and a lower border 117*d* that forms a lower edge of the second outlet 127.

Figure 9:
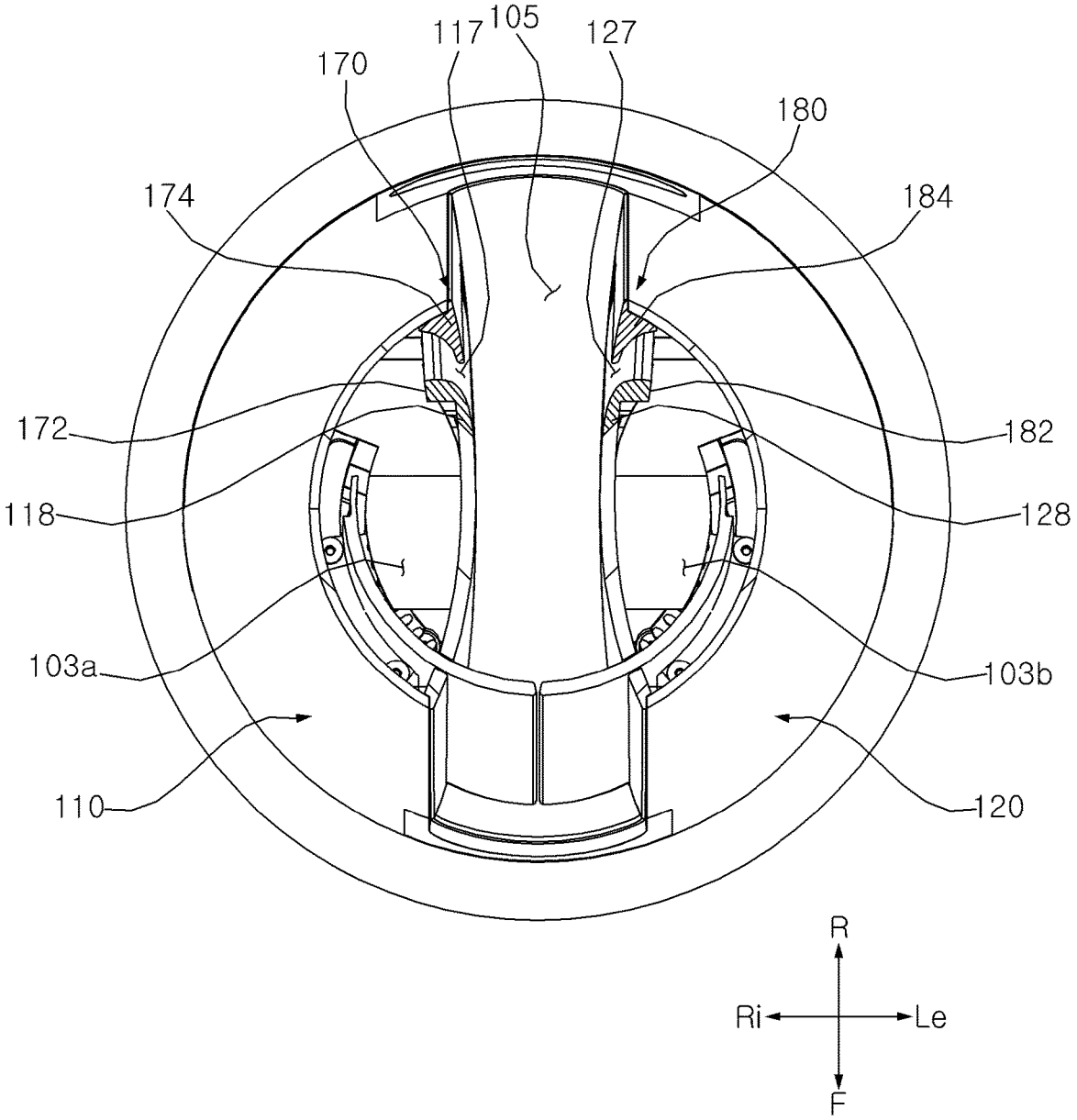
FIG. 9 is a cross-sectional view taken along line IX-IX of FIG. 3.

Referring to FIG. 9, the first outlet 117 of the first tower 110 may be disposed to face the second tower 120, and the second outlet 127 of the second tower 120 may be disposed to face the first tower 110. The air discharged from the first outlet 117 may flow along the inner side wall 115 of the first tower 110 by the Coandă effect. The air discharged from the first outlet 127 may flow along the inner side wall 125 of the second tower 120 by the Coandă effect.

The blower 1 may further include a first discharge case 170 and a second discharge case 180. Referring to FIG. 9, the first outlet 117 may be formed in the first discharge case 170. The first discharge case 170 may be assembled with the first tower 110. The second outlet 127 may be formed in the second discharge case 180. The second discharge case 180 may be assembled to the second tower 120. The first discharge case 170 may be installed to penetrate through the inner side wall 115 of the first tower 110. The second discharge case 180 may be installed to penetrate through the inner side wall 125 of the second tower 120.

A first discharge case 170 may be provided with a first discharge opening 118 is formed in the first tower 110, and a second discharge case 180 may be provided with a second discharge opening 128 is formed in the second tower 120. Referring to FIG. 9, the first discharge case 170 may include a first discharge guide 172 that forms the first outlet 117 and is disposed on the air discharge side of the first outlet 117, and a second discharge guide 174 that forms the first outlet 117 and is disposed on the opposite side of the air discharge of the first outlet 117.

Figure 10:
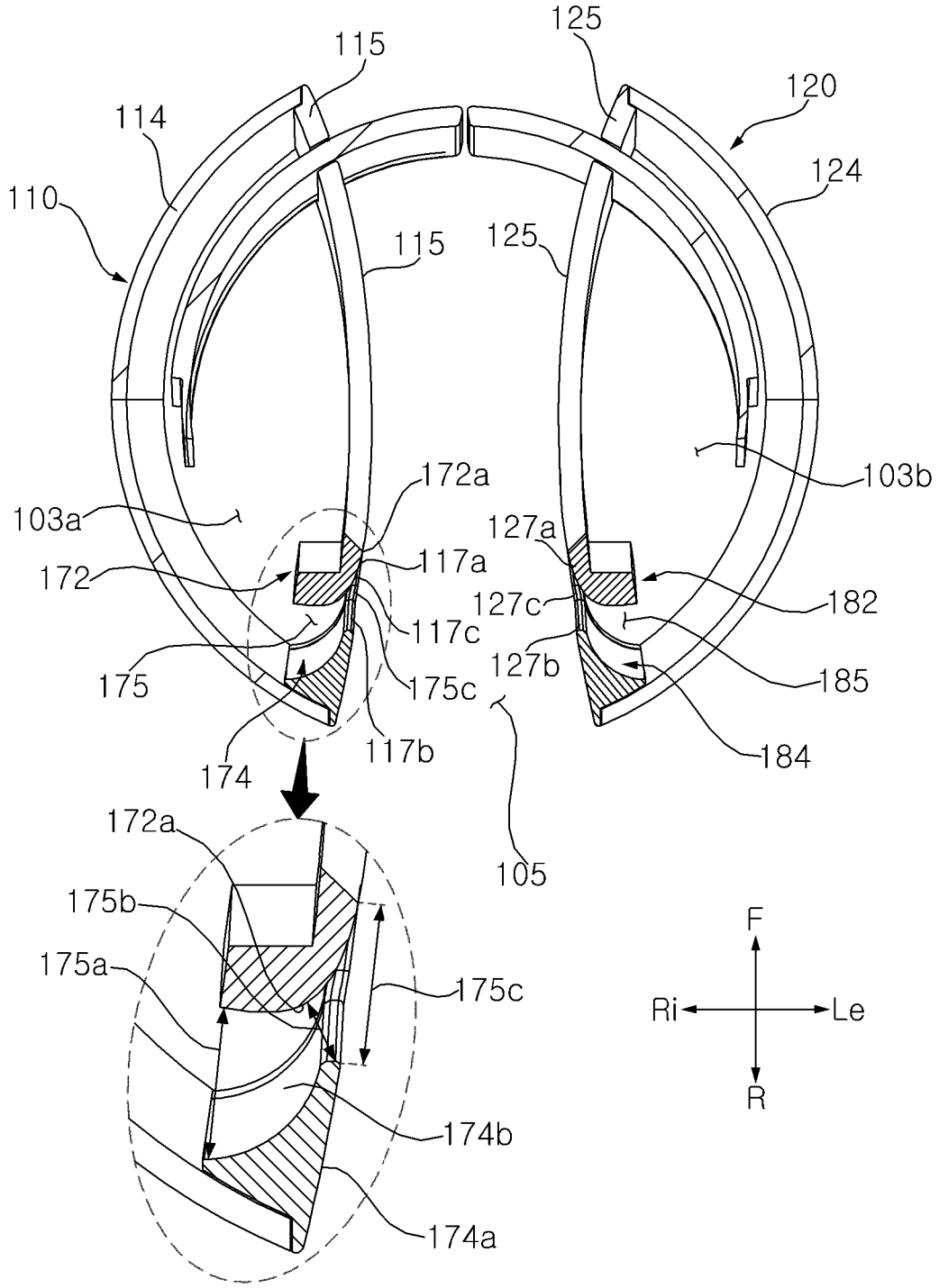
FIG. 10 is a cross-sectional view taken along line IX-IX of FIG. 3.

Referring to FIG. 10, outer side surfaces 172*a* and 174*a* of the first discharge guide 172 and the second discharge guide 174 may provide a portion of the inner side wall 115 of the first tower 110. The inner side of the first discharge guide 172 may be disposed to face the first discharge space 103*a*, the outer side thereof may be disposed to face the blowing space 105. The inner side of the second discharge guide 174 may be disposed to face the first discharge space 103*a*, the outer side thereof may be disposed to face the blowing space 105.

The outer side surface 172*a* of the first discharge guide 172 may be formed as a curved surface. The outer side surface 172*a* of the first discharge guide 172 may provide a surface continuous with the first inner side wall 115. The outer side surface 172*a* of the first discharge guide 172 may form a curved surface continuous with the outer side surface of the first inner side wall 115.

The outer side surface 174*a* of the second discharge guide 174 may provide a surface continuous with the first inner side wall 115. The inner side surface 174*b* of the second discharge guide 174 may have a curved surface. The inner side surface 174*b* of the second discharge guide 174 may form a curved surface continuous with the inner side surface of the first outer side wall 115, and thus, the air in the first discharge space 103*a* may be guided to the first discharge guide 172.

The first outlet 117 may be formed between the first discharge guide 172 and the second discharge guide 174, and the air in the first discharge space 103*a* may be discharged to the blowing space 105 through the first outlet 117. The air in the first discharge space 103*a* may be discharged between the outer side surface 172*a* of the first discharge guide 172 and the inner side surface 174*b* of the second discharge guide 174. A discharge channel 175 through which air is discharged may be formed between the outer side surface 172*a* of the first discharge guide 172 and the inner side surface 174*b* of the second discharge guide 174.

The discharge channel 175 may have a narrower intermediate portion 175*b* than an inlet 175*a* and an outlet 175*c*. The intermediate portion 175*b* may be defined as a portion where the second border 117*b* and the outer side surface 172*a* of the first discharge guide 172 have a relatively shortest distance.

Referring to FIG. 10, a cross-sectional area may be gradually narrowed in a direction from the inlet to the intermediate portion 175*b* of the discharge channel 175, and a cross-sectional area may become wider from the intermediate portion 175*b* to the outlet 175*c*. The intermediate portion 175*b* may be located inside the first tower 110. When viewed from the outside, the outlet 175*c* of the discharge channel 175 may be seen as the outlet 117.

In order to induce or otherwise control the Coandă effect, a radius of curvature of the inner side surface 174*b* of the second discharge guide 174 may be larger than that of the outer side surface 172*a* of the first discharge guide 172. A center of curvature of the outer side surface 172*a* of the first discharge guide 172 may be located in front of the outer side surface 172*a* and may be formed inside the first discharge space 103*a*. The center of curvature of the inner side surface 174*b* of the second discharge guide 174 may be located on the side of the first discharge guide 172 and is formed inside the first discharge space 103*a*.

Referring to FIG. 10, the second discharge case 180 may include a first discharge guide 182 that forms the second outlet 127 and is disposed on the air discharge side of the second outlet 127, and a second discharge guide 184 that forms the second outlet 127 and is disposed on the opposite side of the air discharge of the second outlet 127. A discharge channel 185 may be formed between the first discharge guide 182 and the second discharge guide 184. Since the second discharge case 180 may be symmetrical in the left and right direction with respect to the first discharge case 170, a detailed description thereof will be omitted. However, it should be appreciated that the first discharge case 170 and the second discharge case 180 may have different structures, such as to induce respective different air currents in the first discharge case 170 and the second discharge case 180.

Referring to FIG. 4, the air discharged from the first outlet 117 may flow to the first front end 112 along the first inner side surface 115, and the air discharged from the second outlet 127 may flow to the second front end 122 along the second inner side surface 125. The shortest distance B0 of the first inner side wall 115 and the second inner side wall 125 may be determined to intensively discharge the discharge air forward through the Coandă effect.

As the shortest distance B0 becomes longer, the Coandă effect may become weaker but a relatively wide blowing space 105 may be secured, and as the shortest distance B0 decreases, the Coandă effect may become stronger, but the blowing space 105 becomes relatively narrow. The shortest distance B0 may be formed in a range of 20 mm to 30 mm. In this range, it is possible to secure an air flow width (e.g., a left and right width) of 1.2 m at a distance of 1.5 m in front of the front ends 112 and 122.

In addition, a discharge angle A of the first inner side wall 115 and the second inner side wall 125 may be designed to limit the spread of the discharge air to the left and right. Referring to FIG. 4, the first inner side wall 115 may form a convex curved surface from the area where the first outlet 117 is disposed toward the second inner side wall 125 in the area where the first board slit 119 is disposed. In addition, the second inner side wall 125 may form a convex curved surface from the area where the second outlet 127 is disposed toward the first inner side wall 115 in the area where the second board slit 129 is disposed. In this context, referring to FIG. 4, the discharge angle A may be defined as an angle between the center line L-L' of the first tower 110 and the second tower 120 and a tangent line formed at the front ends 112 and 122 of the inner side walls 115 and 125.

<Air Flow Converter>

On the other hand, the blower 1 may further include an air flow converter 400 for changing the air flow direction of the blowing space 105. Hereinafter, an air flow converter 400 capable of forming an upward air flow will be described with reference to FIGS. 9 to 21. The air flow converter 400 may convert a horizontal air flow flowing through the blowing space 105 into an upward air flow.

The air flow converter 400 may include a first air flow converter 401 disposed in the first tower 110, and a second air flow converter 402 disposed in the second tower 120. The first air flow converter 401 and the second air flow converter 402 may be symmetrical, and may have the same configuration. It should be appreciated that first air flow converter 401 and the second air flow converter 402 may have different structures, such as to induce different air flows from the first tower 110 and the second tower 120, respectively.

The air flowing through the blowing space 105 may flow from the first outlet 117 or the second outlet 127 to the front of the blowing space 105. For example, based on the blowing space 105, the portion where the first outlet 117 and the second outlet 127 may be disposed may be set as an upstream of the blowing space 105, and the first guide board 411 and a portion where the first guide board 411 and the second guide board 412 may be disposed may be set as a downstream of the blowing space 105.

Figure 11:
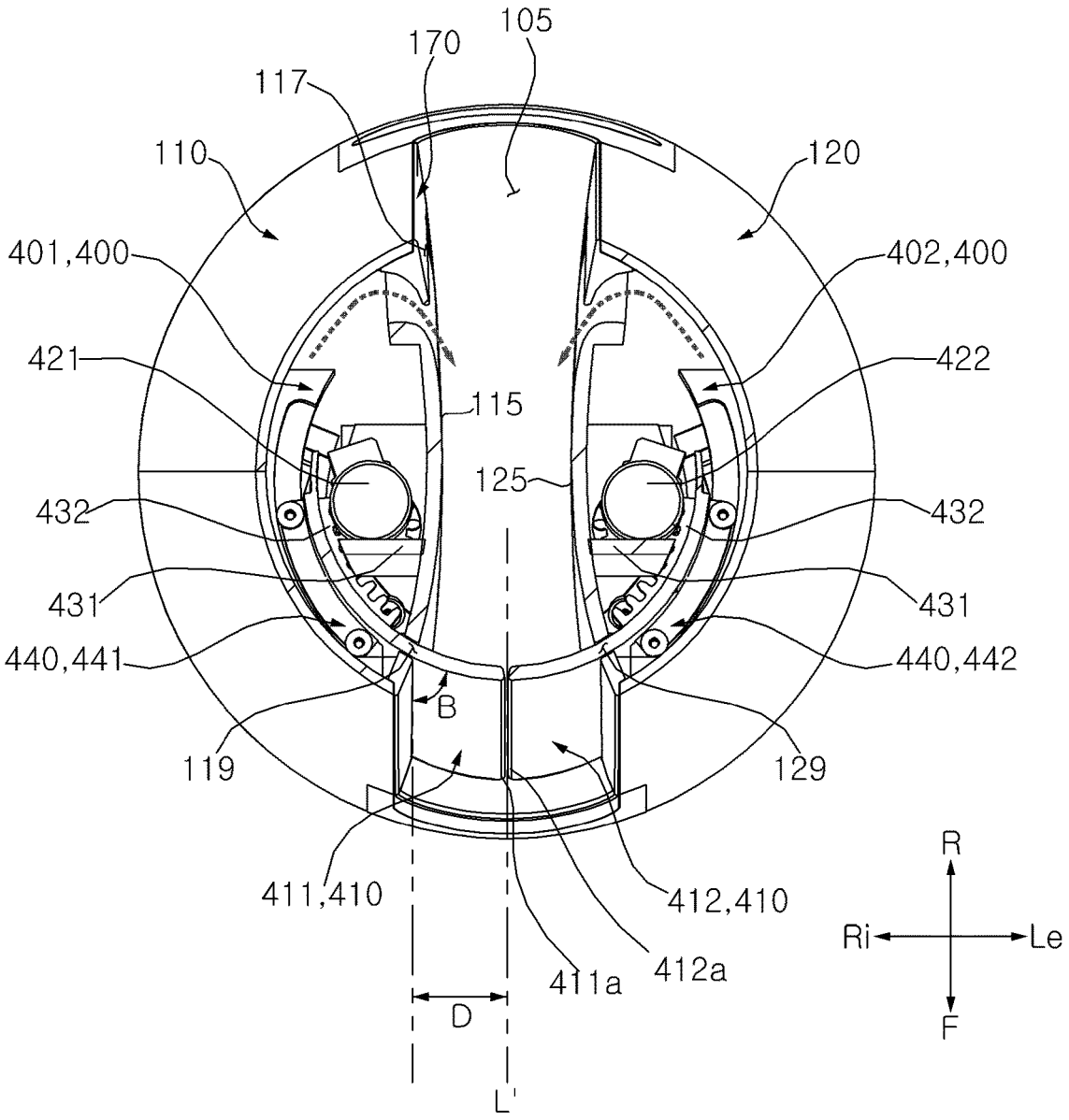
FIG. 11 is a cross-sectional view taken along line XI-XI of FIG. 3.

Referring to FIG. 11, the guide board 410 may include a first guide board 411 that is disposed on the first tower 110; and a second guide board 412 that is disposed on the second tower 120. The first guide board 411 may be disposed inside the first tower 110 and may selectively protrude to the blowing space 105. The second guide board 412 may be disposed inside the second tower 120 and may selectively protrude to the blowing space 105.

A first board slit 119 may be formed on the inner side wall 115 of the first tower 110, and a second board slit 129 may be formed on the inner side wall 125 of the second tower 120. The first board slit 119 and the second board slit 129 may be symmetrically disposed. The first board slit 119 and the second board slit 129 may be formed to extend long in the up-down direction. Referring to FIG. 5, the first board slit 119 and the second board slit 129 may be disposed to be inclined with respect to the vertical direction V.

An inner side end 411*a* of the first guide board 411 may be exposed to the first board slit 119, and an inner side end 412*a* of the second guide board 412 may be exposed to the second board slit 129. When the first guide board 411 is disposed on the inside of the first tower 110, the inner side end 411*a* of the first guide board 411 may be disposed so as not to protrude from the inner side wall 115. When the second guide board 412 is disposed on the inside of the second tower 120, the inner side end 412*a* of the second guide board 412 may be disposed so as not to protrude from the inner side wall 115. The first guide board 411 may be disposed parallel to the first board slit 119, and the second guide board 412 may be disposed parallel to the second board slit 129.

Referring to FIG. 5, each of the first board slit 119 and the second boss slit 129 in the vertical direction may be disposed to be more inclined than the front end 112 of the first tower 110 or the front end 122 of the second tower 120. For example, the front end 112 of the first tower 110 may be formed at an inclination of 3°, and the first board slit 119 may be formed at an inclination of 4°. Similarly, the front end 122 of the second tower 120 may be formed at an inclination of 3°, and the second board slit 129 may be formed at an inclination of 4°.

The guide board 410 may be formed in a flat or curved plate shape. The guide board 410 may be formed to extend long in the up-down direction, and may be disposed in front of the blowing space 105. The guide board 410 may block the horizontal air flow flowing into the blowing space 105 and the direction of the guide board 410 may switch to the upward direction.

Referring to FIG. 11, the inner side end 411*a* of the first guide board 411 and the inner side end 412*a* of the second guide board 412 may contact or come close to each other to form the upward air flow. In another example, one guide board 410 may be in close contact with the opposite tower to form the upward air flow.

As illustrated in FIG. 2A, when the blower 1 forms the horizontal air flow, the inner side end 411*a* of the first guide board 411 may close the first board slit 119, and the inner side end 412*a* of the second guide board 412 may close the second board slit 129. As the first guide board 411 closes the first board slit 119, it is possible to prevent the air in the first discharge space 103*a* from leaking into the first board slit 119. As the second guide board 412 closes the second board slit 129, it is possible to prevent the air in the second discharge space 103*a* from leaking into the second board slit 129.

As illustrated in FIG. 2B, when the blower 1 forms the upward air flow, the inner side end 411*a* of the first guide board 411 may pass through the first board slit 119 and protrude to the blowing space 105, and the inner side end 412*a* of the second guide board 412 may pass the second board slit 129 and protrude to the blowing space 105.

The first guide board 411 and the second guide board 412 protrude to the blowing space 105 by a rotational operation. In another example, at least one of the first guide board 411 and the second guide board 412 may linearly move in a slide manner and protrude to the blowing space 105. Referring to FIG. 11, the first guide board 411 and the second guide board 412 may be formed in an arc shape. The first guide board 411 and the second guide board 412 may form a predetermined radius of curvature, and the center of curvature may be located in the blowing space 105.

Hereinafter, a configuration of the air flow converter 400 will be described with reference to the first air flow converter 401 disposed in the first tower 110 with reference to FIGS. 11 to 21. The air flow converter 400 described below may also be applied to the second air flow converter 402. Each configuration of the air flow converter 400 described below may be divided into a "first" configuration disposed in the first tower 110 and a "second" configuration disposed in the second tower 120.

Figure 13:
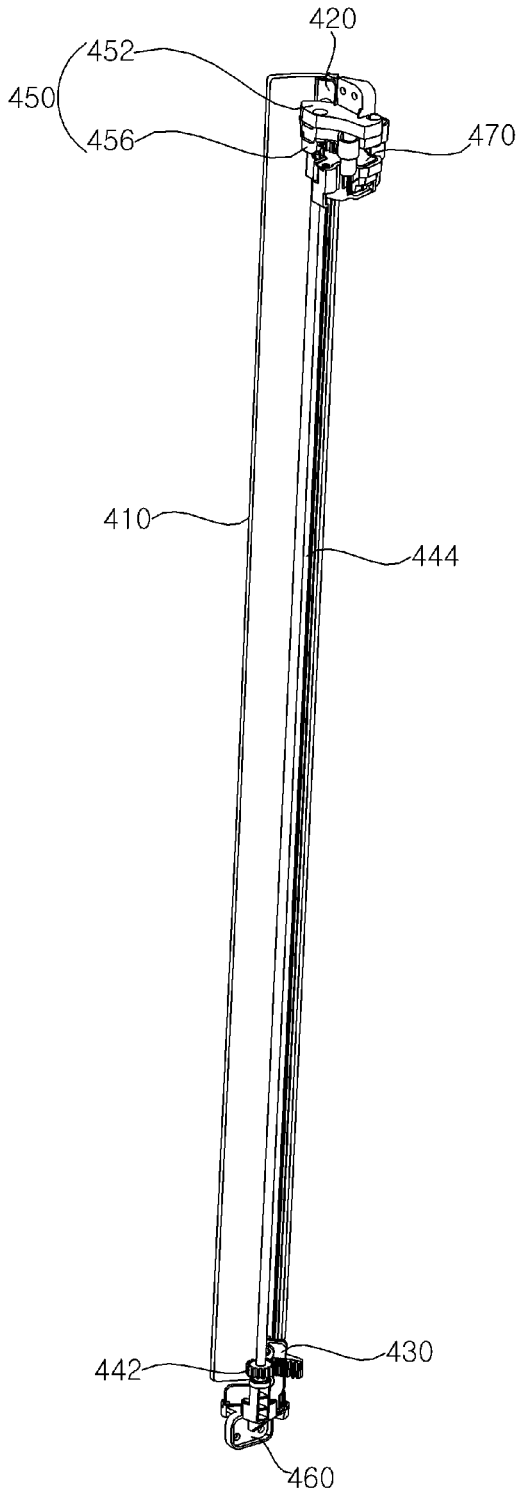
FIG. 13 is an exploded perspective view of the air flow converter according to the embodiment of the present disclosure.

Referring to FIG. 13, the air flow converter 400 may include one or more of a guide board 410 that is disposed on the tower and protrudes to the blowing space 105, a pair of board guiders (or guides) 420 and 430 that are mounted on the guide board 410 and change the disposition of the guide board 410, a pair of driving gears 440 and 442 that are rotatably disposed inside the first tower 110 or the second tower 120 and engage with the pair of board guiders 420 and 430, a shaft 444 that connects a pair of driving gears 440 and 442, and a driving motor 470 that is connected to one of the pair of driving gears 440 and 442 to provide a driving force. It should be appreciated that the air flow converter 400 may include additional, fewer, or different component.

Referring to FIG. 13, the air flow converter 400 may be fixedly disposed on the inside the first tower 110 or the second tower 120 and may include a pair of supports 450 and 460 that guide the movement of each of the pair of board guiders 420 and 430. The pair of supports 450 and 460 may contact upper and lower ends of the shaft 444, respectively, and support the rotation of the shaft 444. The air flow converter 400 may be connected to the driving motor 470 to rotate and may include a motor gear 472 that is disposed to engage with one of the pair of driving gears 440 and 442.

The guide board 410 may be hidden inside the tower, or may protrude to the blowing space 105. The guide board 410 may be made of a transparent material.

Referring to FIG. 13, a pair of board guiders 420 and 430 may include an upper guider 420 that is disposed on an upper end portion of the guide board 410 and a lower guider 430 that is disposed on a lower end portion of the guide board 410. The pair of driving gears 440 and 442 may include an upper gear 440 that is disposed to engage with the upper guider 420 and a lower gear 442 that is disposed to engage with the lower guider 430. The pair of supports 450 and 460 may include an upper support 450 that guides the movement of the upper guider 420 and a lower support 460 that guides the movement of the lower guider 430.

Figure 14:
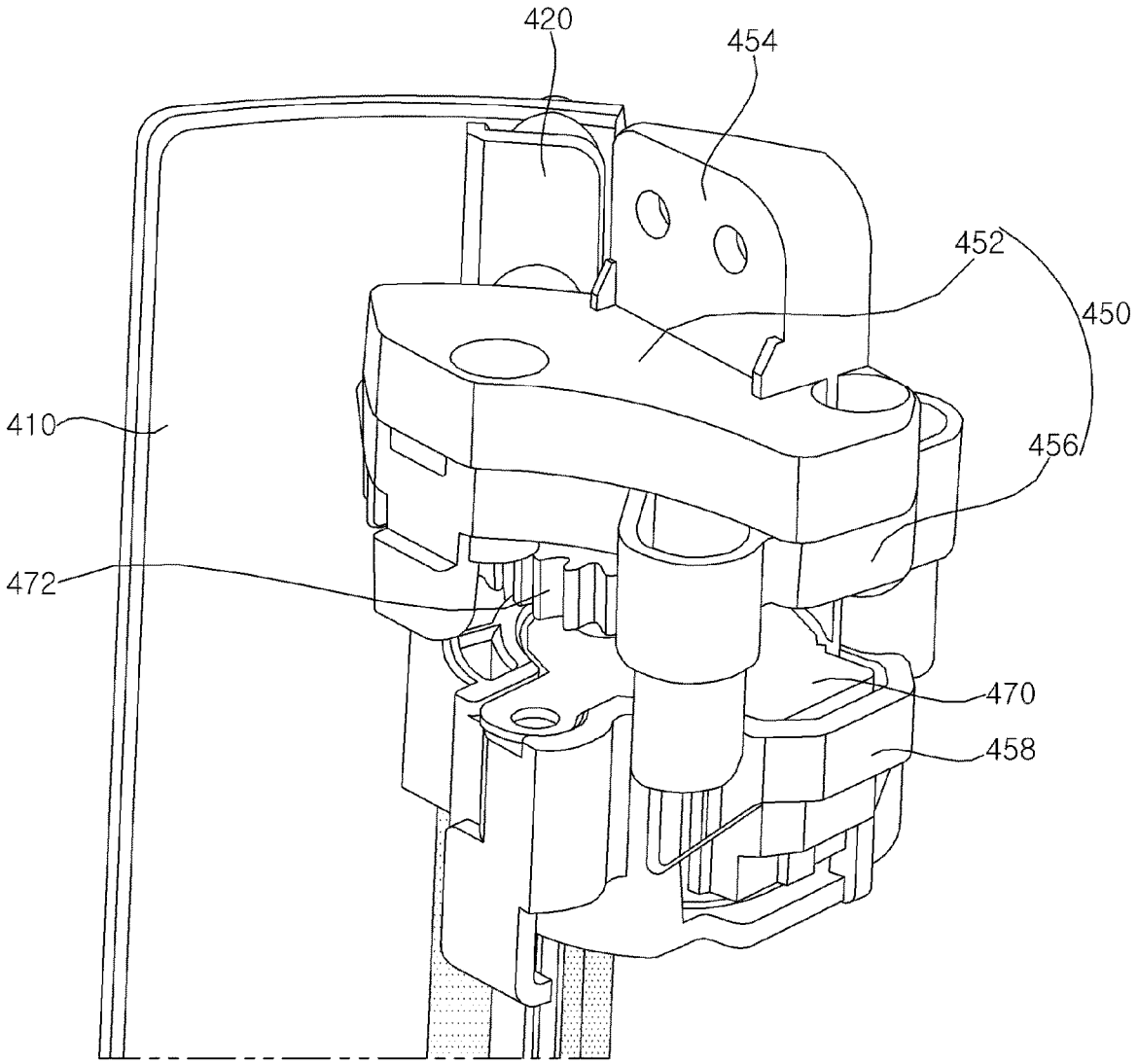
FIG. 14 is a diagram for describing a disposition and connection relationship of an upper portion of a guide board, an upper guide, and an upper support according to an embodiment of the present disclosure.
Figure 18:
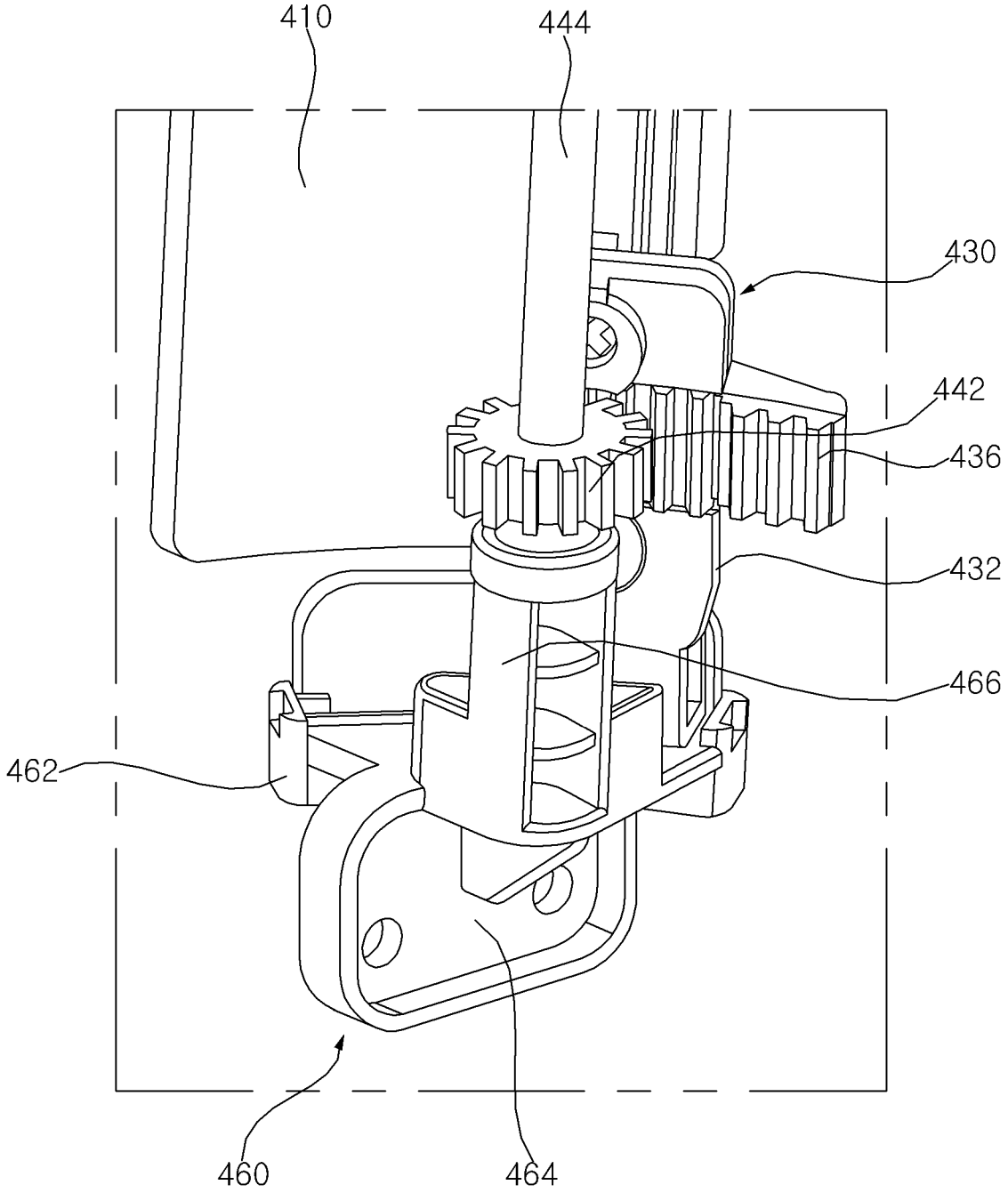
FIG. 18 is a diagram for describing a disposition and connection relationship of a lower portion of the guide board, a lower guide, and a lower support according to an embodiment of the present invention.

Referring to FIG. 14, the upper guider 420 may be connected to the upper support 450 and may move in engagement with the upper gear 440. Referring to FIG. 18, the lower guider 430 may connected to the lower support 460 and may move in engagement with the lower gear 442.

Figure 15:
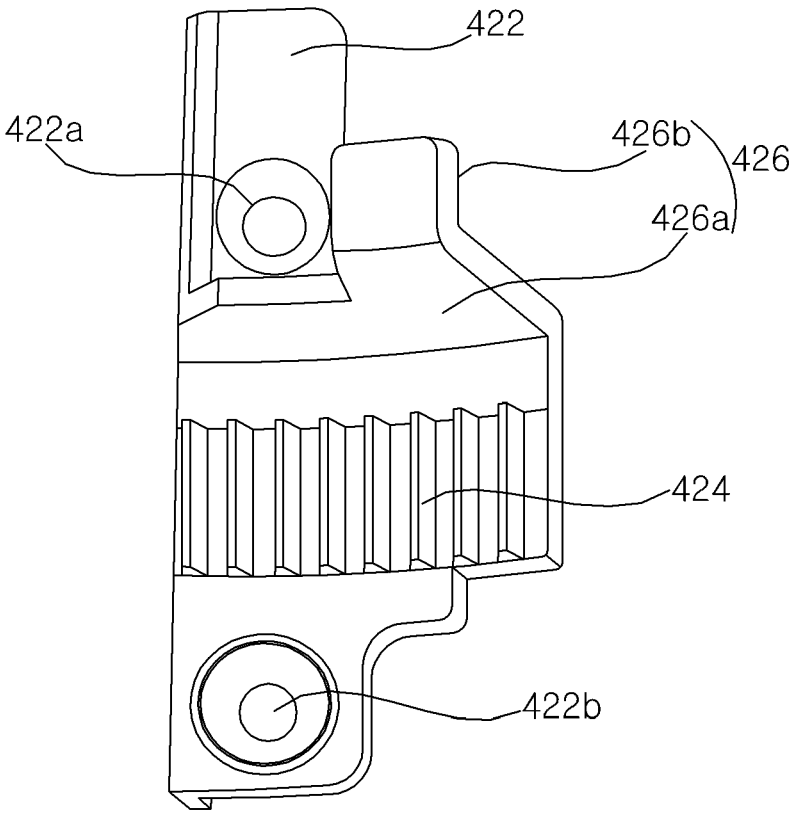
FIG. 15 view for describing an upper guider disposed above a guide according to an embodiment of the present invention.

Referring to FIG. 15, the upper guider 420 may include one or more of an upper board mounter (also referred to herein as upper board mount or upper board mounting wall) 422 that fixes the upper guider 420 to one side of the guide board 410, an upper board gear 424 that engages with the upper gear 440 to change the disposition of the upper guider 420, and an upper guide rib 426 that is inserted into an upper guide groove (not illustrated) formed in the upper support 450 to guide the movement of the upper guider 420.

Referring to FIG. 15, the upper board mounter 422 may extend upward and downward of the upper board gear 424. In the upper board mounter 422, upper fastening holes 422*a* and 422*b* may be formed to be connected to the guide board 410. A pair of upper fastening holes 422*a* and 422*b* may be spaced apart from each other in an up-down direction. An upper board gear 424 may be disposed between the pair of upper fastening holes 422*a* and 422*b*. An upper guide rib 426 may be disposed between the pair of upper fastening holes 422*a* and 422*b*. The upper guider 420 and the guide board 410 may be fastened through the pair of upper fastening holes 422*a* and 422*b*. Accordingly, the disposition of the guide board 410 may be changed according to the movement of the upper guider 420. The upper board mounter 422 may be disposed above and below the upper board gear 424.

Referring to FIG. 15, the upper board gear 424 may extend downward of the upper board mounter 422, and a gear engaging with the upper gear 440 may be disposed on the opposite surface facing the guide board 410. The gear formed on the upper board gear 424 may have a shape of a rack gear. For example, the upper board gear 424 and the upper gear 440 may have a rack and pinion structure. Accordingly, as the upper gear 440 rotates, the upper board gear 424 may move the disposition of the guide board 410.

Referring to FIG. 15, the upper guide rib 426 may be disposed between the upper board mounter 422 and the upper board gear 424. The upper guide rib 426 may have a structure that protrudes from the surface on which the upper board gear 424 is formed. The upper guide rib 426 may include an upper horizontal rib 426*a* that protrudes in a direction in which the upper support 450 is disposed between the upper board gear 424 and the upper board mounter 422, and an upper vertical rib 426*b* that protrudes upward from the end portion of the upper horizontal rib 426*a*. The upper vertical rib 426*b* may be disposed to be inserted into the upper guide groove (not illustrated) of the upper supporter 450. When viewed from the upper side, the upper vertical rib 426*b* may have a curved shape having the same center of curvature as the center of curvature of the guide board 410.

Figure 16:
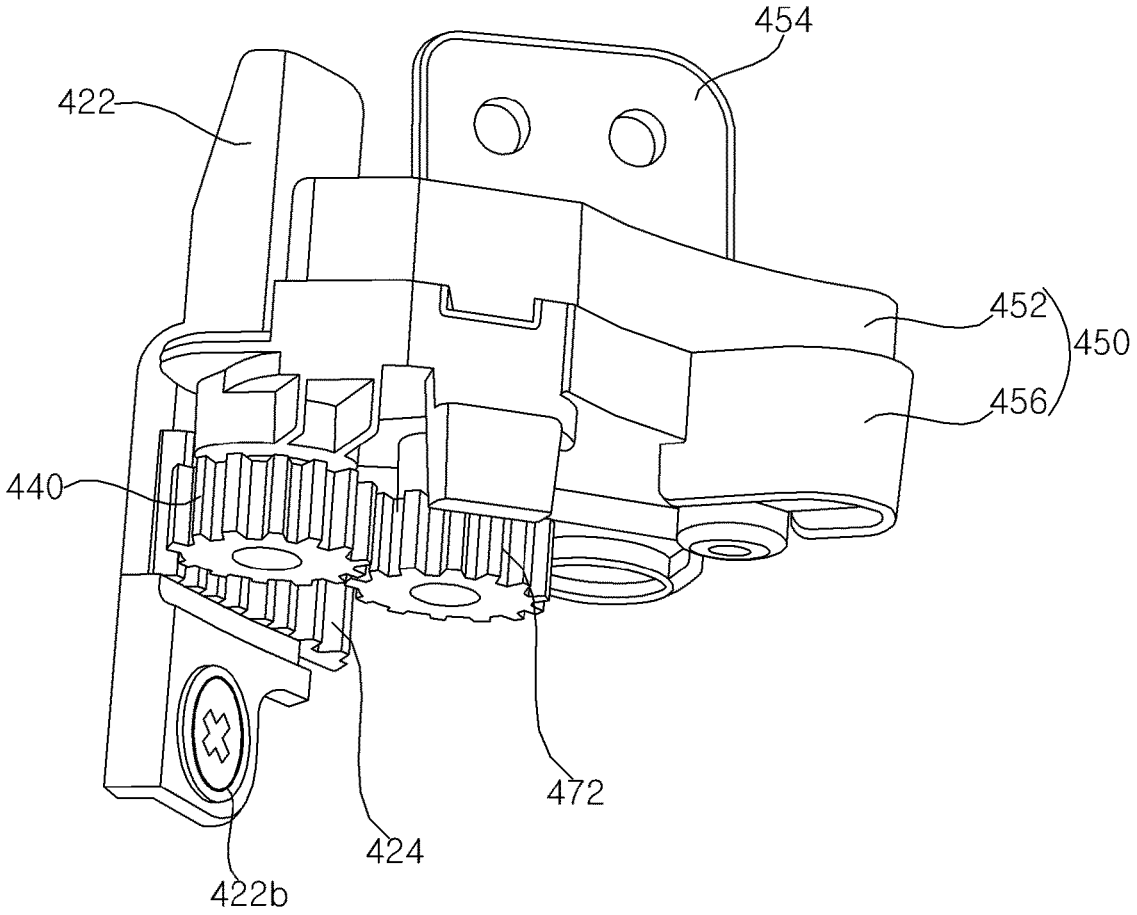
FIG. 16 is an exploded perspective view of the upper guider, the upper supporter, and the driving motor according to an embodiment of the present invention.

The upper support 450 may be provided with an upper guide groove formed to guide the movement of the upper guide rib 426. The upper support 450 may be fixedly disposed on the inside of the first tower 110 or the second tower 120. Referring to FIG. 16, the upper support 450 may include an upper case mounter (or upper case mount) 454 fixed on the inside of the first tower 110 or the second tower 120.

Referring to FIG. 16, the upper support 450 may include an upper fixing body 452 that may be mounted on the inside of the first tower 110 and/or the second tower 120, and an upper fastening body 456 that may be coupled to the upper fixing body 452 and is mounted with a driving motor 470. The upper fixing body 452 and the upper fastening body 456 are coupled to each other. The upper fixing body 452 may be disposed above the upper fastening body 456. The upper fastening body 456 may include an upper support plate 457 that supports the upper horizontal rib 426*a* of the upper guider 420, and the upper fixing body 452 may be provided with an upper guide groove that guides the movement of the upper vertical rib 426*b*. The upper guide groove may limit the movement range of the upper vertical rib 426*b*.

Figure 17:
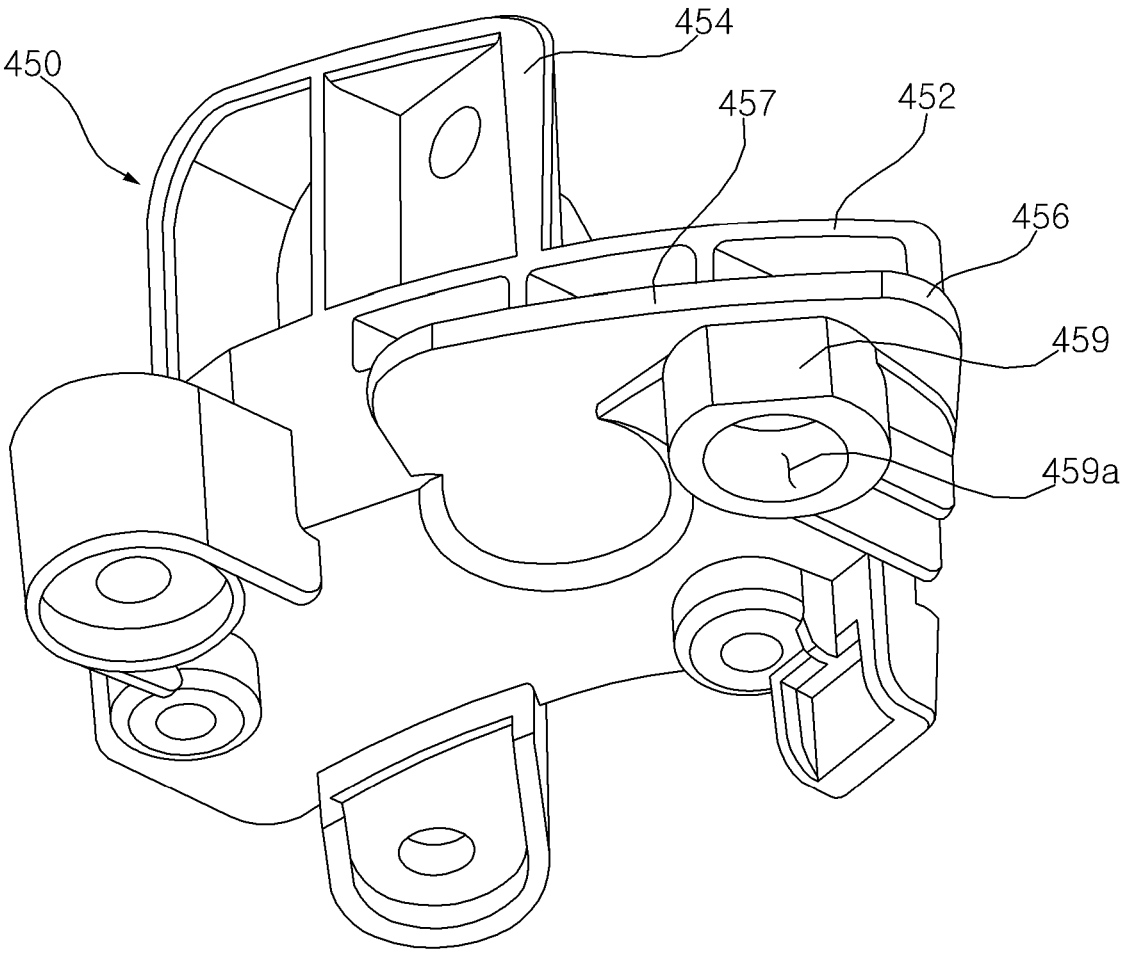
FIG. 17 is a bottom perspective view of the upper support of FIG. 16 according to an embodiment of the present invention.

Referring to FIG. 16, the driving motor 470 may be mounted on the lower side of the upper fastening body 456. The driving motor 470 may be fixedly disposed on the lower side of the upper fastening body 456. Referring to FIGS. 16 and 17, the lower surface of the upper fastening body 456 may have a motor mounting part (or motor mount) 458 to which the driving motor 470 is fixed, and an upper shaft mounting part (or upper shaft mount) 459 into which one end of the shaft 444 may be inserted. The upper shaft mounting part 459 may have an upper end of the shaft 444 inserted thereinto, and may be provided with a rotatable upper shaft groove 459*a*.

An upper gear 440 may be disposed on the upper end portion of the shaft 444. The upper gear 440 may be fixedly disposed to the shaft 444. Accordingly, when the upper gear 440 rotates, the shaft 444 may also rotate.

Figure 12:
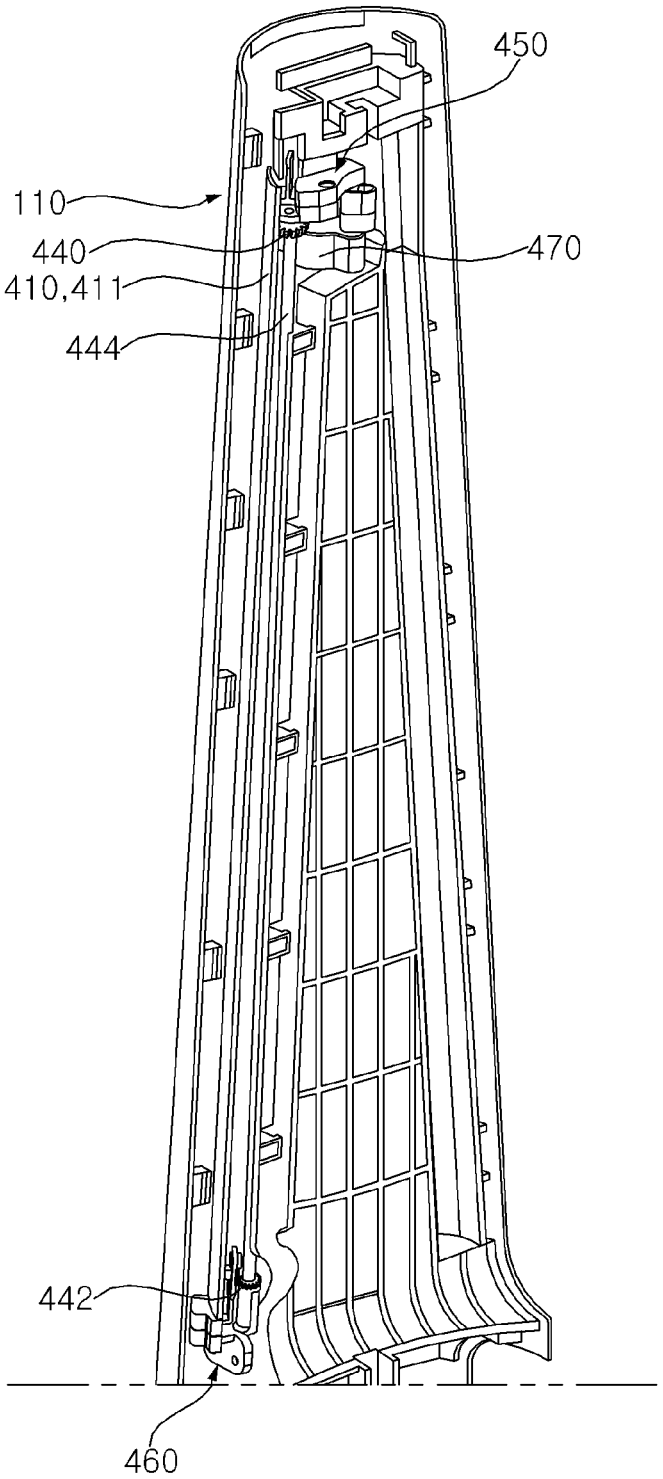
FIG. 12 is a view for describing an air flow converter disposed inside the first tower according to an embodiment of the present disclosure.

Referring to FIG. 12, the shaft 444 may be disposed to be inclined at a set angle based on an imaginary axis Z formed perpendicular to the ground. The shaft 444 may be inclinedly disposed to correspond to the direction in which the first board slit 119 or the second board slit 129 formed on each of the first inner side wall 115 or the second inner side wall 125 is formed.

The upper gear 440 may be disposed to engage with the motor gear 472 connected to the driving motor 470. In addition, when the upper gear 440 is rotated in engagement with the motor gear 472 on one side, the upper gear 440 may change the disposition of the upper board gear 424 by engaging with the upper board gear 424 of the upper guider 420 on the other side. Also, when the upper gear 440 rotates in engagement with the motor gear 472, the shaft 444 may rotate to rotate the lower gear 442 disposed on the lower end portion of the shaft 444.

Referring to FIG. 18, the lower guider 430 may be connected to the lower support 460, and may move in engagement with the lower gear 442. The lower guider 430 may be connected to the lower support 460 and may move in engagement with the lower gear 442.

Figure 19:
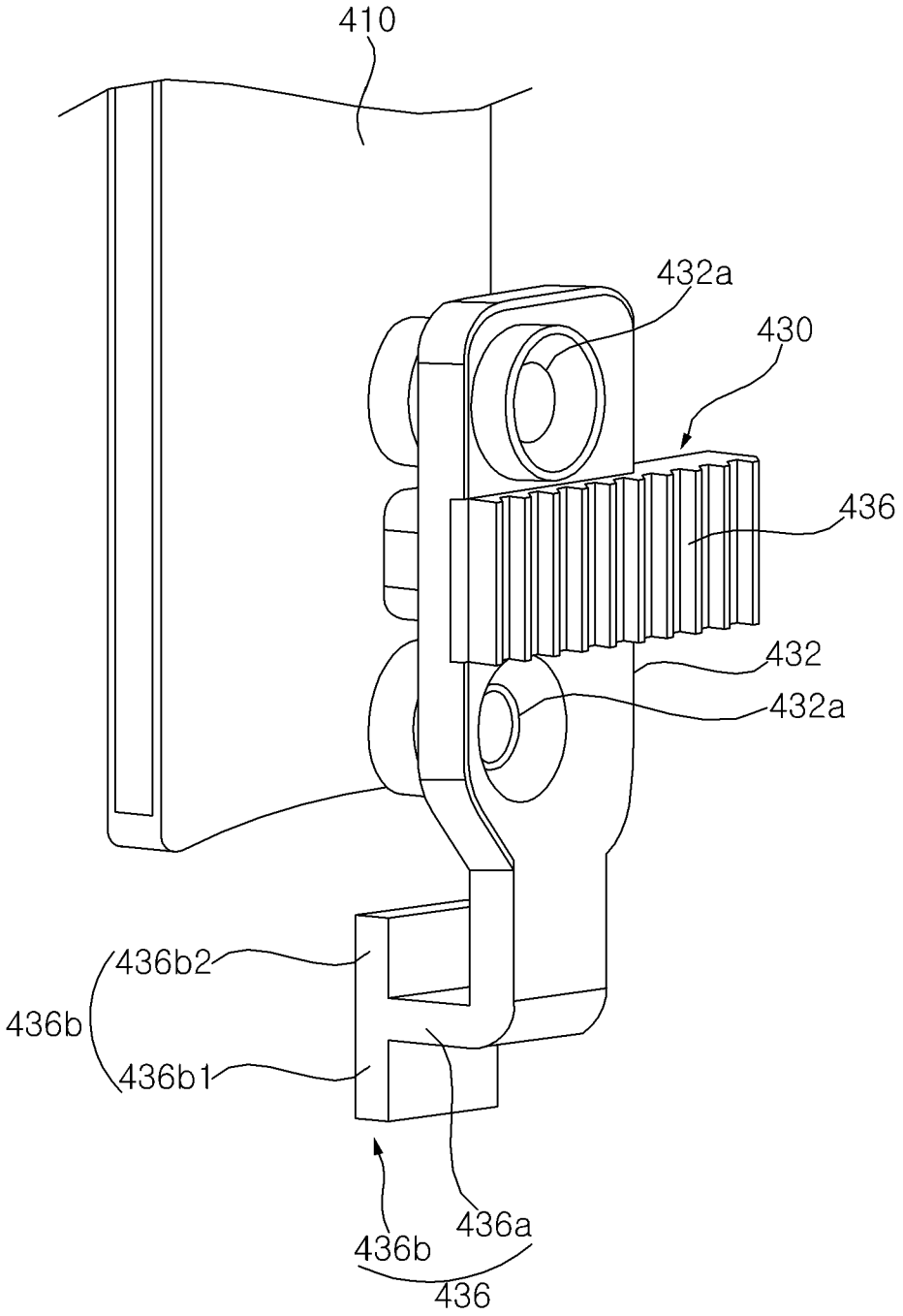
FIG. 19 is a diagram for describing a lower guider disposed below the guide according to the embodiment of the present invention.

Referring to FIG. 19, the lower guider 430 may include one or more of a lower board mounter (or lower board mount or lower board mounting wall) 432 that fixes the lower guider 432 to one side of the guide board 410, a lower board gear 434 that engages with the lower gear 442 to change the disposition of the lower guider 430, and a lower guide rib 436 that is inserted into a lower guide groove 462*a* formed in the lower support 460 to guide the movement of the upper guider 430.

Referring to FIG. 19, the lower board mounter 432 may extend in the up-down direction of the lower board gear 434. The lower board mounter 432 may be provided with a plurality of lower fastening holes 432*a* to be connected to the guide board 410. A plurality of lower fastening holes 432*a* may be disposed to be separated from each other in an up-down direction with respect to the lower board gear 434. The lower guider 430 and the guide board 410 may be fastened through at least one of the plurality of lower fastening holes 432*a*. Accordingly, the disposition of the guide board 410 may be changed according to the movement of the lower guider 430. The lower board mounter 432 may be disposed above and below the lower board gear 434.

Referring to FIG. 19, the lower board gear 434 may be disposed between the plurality of lower fastening holes 432*a* formed in the lower board mounter 432 in the up-down direction. In the lower board gear 434, a rack gear engaging with the lower gear 442 may be disposed on the opposite surface facing the guide board 410. The lower board gear 434 and the lower gear 442 may have a rack and pinion structure. Accordingly, as the lower gear 442 rotates, the lower board gear 434 may move in the direction in which the lower board gear 434 is formed.

The lower guide rib 436 may extend from the lower end portion of the lower board mounter 432. The lower guide rib 436 may have a structure extending to a surface opposite to the surface on which the lower board gear 434 is formed. For example, the upper guide rib 426 and the lower guide rib 436 may have a structure in which they protrude in opposite directions.

The lower guide rib 436 may include a lower horizontal rib 436*a* that protrudes from the lower end portion of the lower board mounter 432 in the direction in which the lower support 460 is disposed, and a lower vertical rib 436*b* that protrudes in the up-down direction from the end portion of the lower horizontal rib 436*a*. The lower horizontal rib 436*a* protrudes in the direction of the guide board 410.

The lower vertical rib 426*b* may be disposed to be inserted into the lower guide groove 462*a* of the lower supporter 460. The lower vertical rib 436*b* may include an upper rib 436*b*2 that extends upward from the end portion of the lower horizontal rib 436*a* and a lower rib 436*b*1 that extends downward from the end portion of the lower horizontal rib 436*a*. When viewed from the upper side, the lower vertical rib 436*b* may have a curved shape having a substantially same center of curvature as the center of curvature of the guide board 410.

Figure 20:
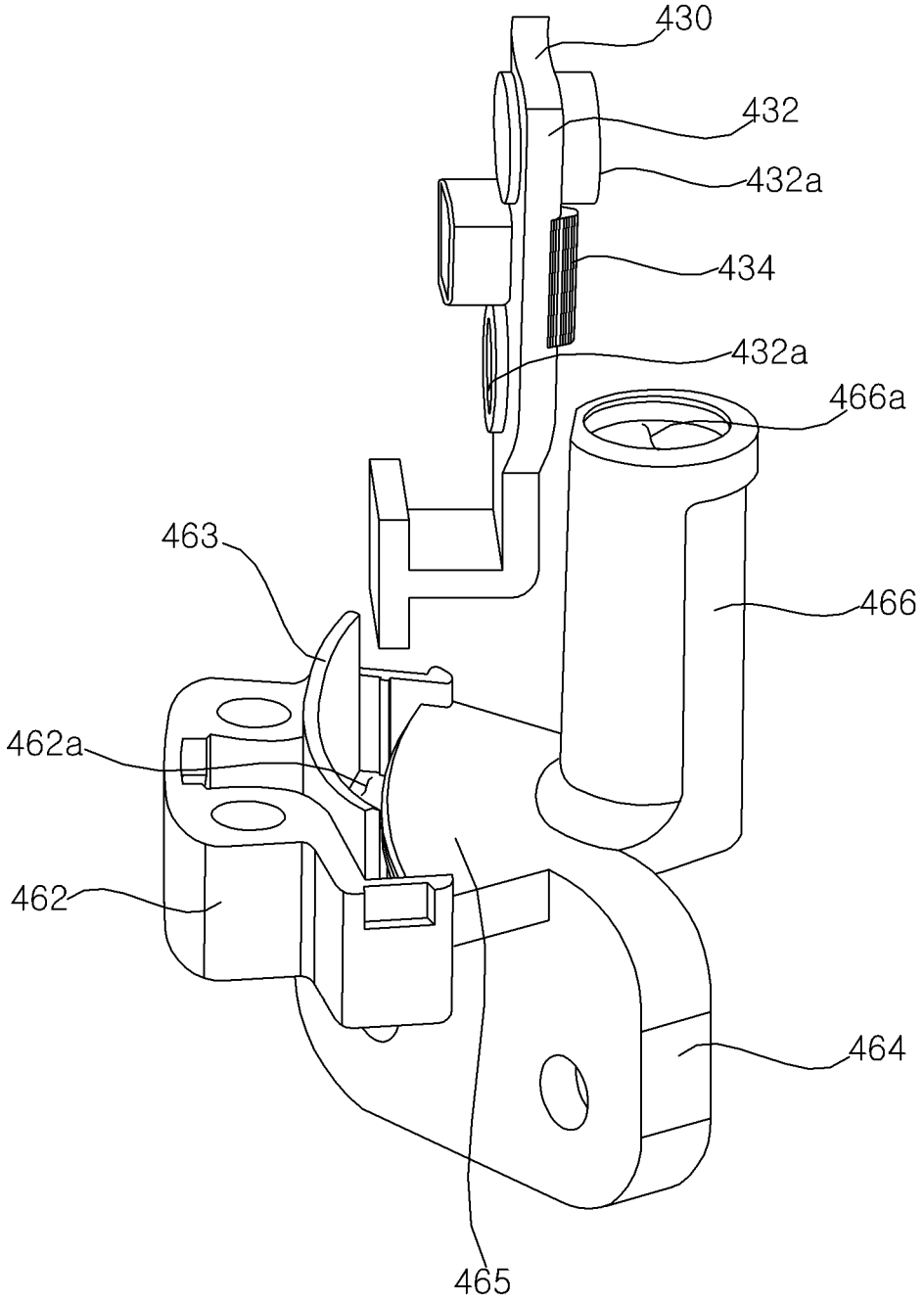
FIG. 20 is an exploded perspective view of the lower guider and the lower support according to the embodiment of the present invention.
Figure 21:
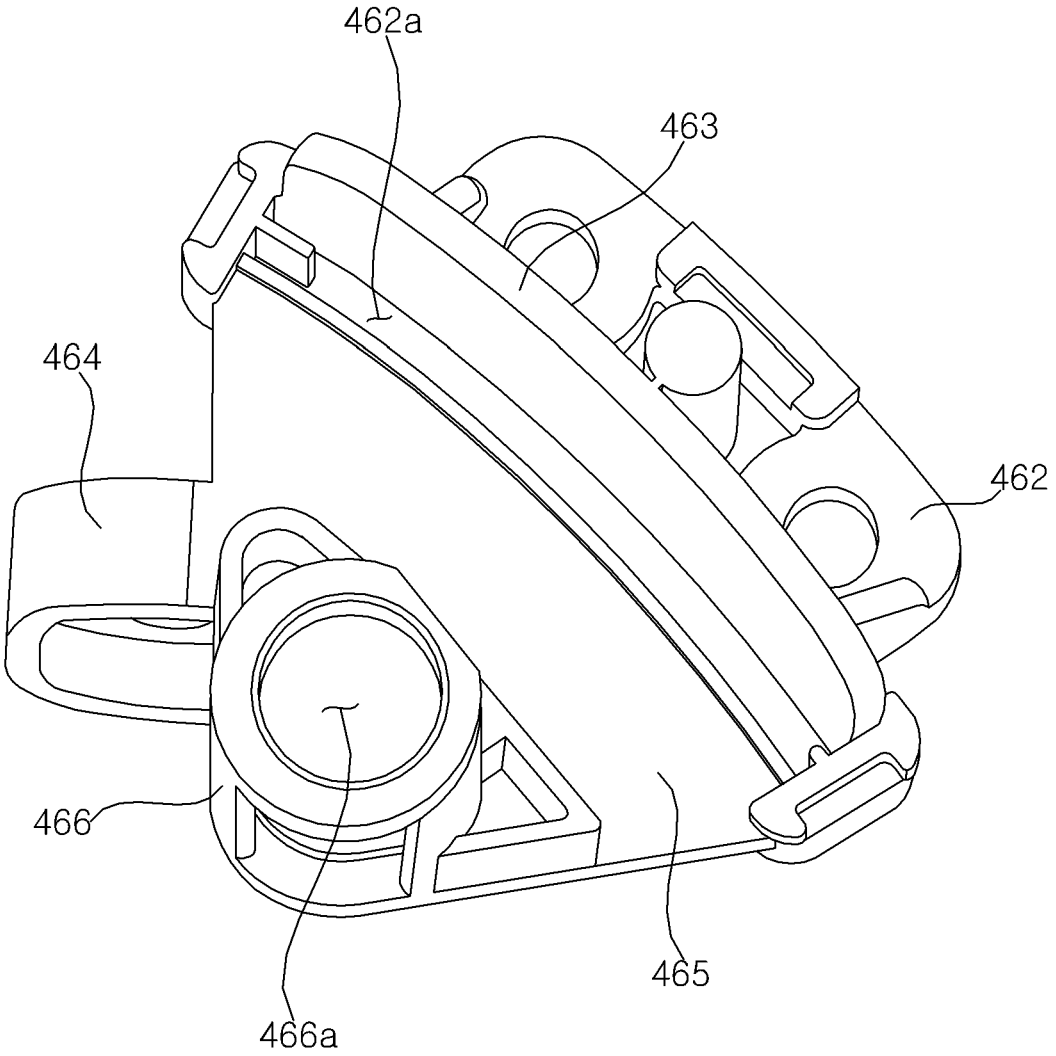
FIG. 21 is a plan view of the lower support according to the embodiment of the present invention.

Referring to FIGS. 20 and 21, the lower support 460 may be provided with a lower guide groove 462*a* formed to guide the movement of the lower guide rib 436. The lower guide groove 462*a* may include the lower guide groove 462*a* into which the lower rib 436*b*1 is inserted, and an additional guide groove (not illustrated) into which the upper rib 436*b*2 is inserted.

The lower support 460 may be fixedly disposed on the inside of the first tower 110 or the second tower 120. The lower support 460 may include a lower case mounter 464 fixed to the inside of the first tower 110 or the second tower 120. The lower support 460 may include a lower fixing body 462 mounted on the inside of the first tower 110 or the second tower 120.

The lower fixing body 462 may include a lower support plate 465 that supports the lower horizontal rib 436*a* of the upper guider 420. The lower fixing body 462 may be provided with the lower guide groove 462*a* formed to guide the movement of the lower guide rib 434. The lower fixing body 462 may include a guide wall 463 that prevents the lower guide rib 436 from moving in a direction perpendicular to the moving direction of the lower guider 430. The guide wall 463 may be disposed in an opposite direction of a lower shaft mounting portion 466 with respect to the lower guide groove 462*a*. The guide wall 463 may have a structure in which the upper rib 436*b*2 protrudes upward to correspond to the protruding height thereof. Accordingly, when the lower guide rib 434 is inserted into the lower guide groove 462*a*, the lower rib 436*b*1 may be disposed in the lower guide groove 462*a*, and the upper rib 436*b*2 may be disposed to face the guide wall 463.

The upper guide rib 426 and the lower guide rib 436 may extend in different directions. Referring to FIG. 15, the upper horizontal rib 426*a* of the upper guide rib 426 may extend in a direction away from the guide board 410, and referring to FIG. 19, the lower horizontal rib 436*a* of the lower guide rib 436 may extend in a direction of the guide board 410.

In addition, referring to FIG. 15, the upper vertical rib 426*b* of the upper guide rib 426 may extend upward, and referring to FIG. 19, the lower vertical rib 436*b* of the lower guide rib 436 may extend downward. For example, the lower rib 436*b*1 of the lower vertical rib 436*b* may extend downward. Accordingly, the upper guide groove may be formed upward, and the lower guide groove 462*a* may be formed downward.

The lower guide groove 462*a* may limit the movement range of the lower vertical rib 436*b*. The lower fixing body 462 may be provided with the lower shaft mounting portion 466 into which the other end of the shaft 444 may be inserted. The lower shaft mounting portion 466 may be provided with a lower shaft groove 466*a* into which the lower end of the shaft 444 may be inserted and rotate.

The present disclosure is directed to a blower capable of implementing direct wind and indirect wind. Another aspect of the present disclosure is directed to a blower capable of changing a disposition of a guide board for controlling a wind direction of the blower with a simple driving device. Aspects of the present disclosure are not limited to the above-mentioned aspects. For example, other aspects that are not described may be obviously understood by those skilled in the art from the following specification.

According to the present disclosure, a blower may include: a lower case that has an inlet provided therearound and has an opened upper side; a first tower that extends upward from the lower case and has a first outlet opened forward on a first wall; a second tower that extends upward from the lower case, is spaced apart from the first wall, and has a second outlet opened forward on a second wall facing the first wall; a fan that is disposed in the lower case and makes air introduced from the inlet flow to an upper side in which the first tower and the second tower are disposed, thereby making air flowing upward by the fan flow into the space between the first tower and the second tower. In addition, the blower may include a first air flow converter that is disposed in front of the first outlet, disposed inside the first tower, or protrudes from the first wall in a direction in which the second tower is disposed; and a second air flow converter that is disposed in front of the first outlet, disposed inside the second tower, or protrudes from the second wall in a direction in which the first tower is disposed, thereby changing the wind direction of the air flowing forward through between the first and second towers.

Each of the first air flow converter and the second air flow converter includes: a guide board that is disposed inside the first tower or the second tower or protrudes through a first wall or a second wall; an upper gear that rotates in engagement with an upper portion of the guide board; a lower gear that rotates in engagement with a lower portion of the guide board; a shaft that is connected to each of the upper gear and the lower gear to rotate together; and a motor that is connected to one of the upper gear and the lower gear to provide a driving force, so, even if the guide board has a structure formed long in an up-down direction, it is possible to change the disposition with only one driving motor.

The air flow converter may include: an upper guider that is fixedly disposed above the guide board and engages with the upper gear to move the disposition of the guide board; and a lower guider that is fixedly disposed below the guide board and engages with the lower gear to move the disposition of the guide board, thereby changing the disposition of the guide board according to the operation of the drive motor.

The air flow converter may include: an upper support that is fixedly disposed inside the first tower or the second tower and limits a movement range of the upper guider; and a lower support that is fixedly disposed inside the first tower or the second tower and limits a movement range of the lower guider, thereby guiding the movement of the guide board.

An upper shaft groove into which an upper end of the shaft is inserted may be formed in the upper support, a lower shaft groove into which a lower end of the shaft is inserted may be formed in the lower support, and the shaft may be rotatably disposed in each of the upper shaft groove and the lower shaft groove, so the shaft may stably rotate in the fixed state.

The upper guider may include an upper board mounter that is fixed to one side of the guide board, an upper board gear that engages with the upper gear to change the disposition of the upper guider, and an upper guide rib that is connected to the upper support to guide the movement of the upper guide, and an upper guide groove limiting the movement range of the upper guide rib may be formed in the upper support, so the upper guide may be mounted on the guide board to move the guide board.

A pair of the upper board mounter may be spaced apart in the vertical direction, and the upper gear may be disposed between the pair of upper board mounters spaced apart in an up-down direction, thereby moving the guide board in a state in which the upper guider is stably mounted on the guide board.

The upper support may include an upper fixing body that is mounted inside the first tower or the second tower, and an upper fastening body that is coupled to the upper fixing body and mounted with the driving motor, and an upper guide groove guiding the movement of the upper guide rib may be formed in the upper fixing body, so the upper guide groove forms a groove in the upward direction.

The lower guider may include a lower board mounter that is fixed to the guide board at a position spaced downward from the upper guider, a lower board gear that engages with the lower gear to change the disposition of the lower guider, and a lower guide rib that is connected to the lower support to guide the movement of the lower guider, and a lower guide groove limiting the movement range of the lower guide rib may be formed in the lower support, so the lower guider is mounted on the guide board to move the guide board.

The upper guide rib and the lower guide rib may extend in different directions, and each of the upper guide groove and the lower guide groove may form a groove in a direction in which the upper guide rib and the lower guide rib extend, thereby limiting the movement of the up-down direction of the guide board.

The upper guide rib may include an upper horizontal rib that protrudes from one side of the upper board mounter in a direction in which the upper support is disposed, and an upper vertical rib that protrudes upward from an end portion of the upper horizontal rib, the lower guide rib may include a lower horizontal rib that protrudes from a lower end portion of the lower board mounter in a direction in which the lower support is disposed, and a lower vertical rib that protrudes from the end portion of the lower horizontal rib in the up-down direction, and the upper horizontal rib may extend in a direction away from the guide board, and the lower horizontal rib may extend in a direction closer to the guide board, thereby stably moving the guide board.

The lower support may include a lower fixing body mounted on the inside of the first tower or the second tower, and the lower fixing body may include a lower support plate that supports the lower horizontal rib, thereby preventing the load of the guide board from concentrating on the lower vertical rib.

The lower fixing body may include a guide wall that prevents the lower guide rib from moving in a direction perpendicular to a moving direction, thereby preventing the guide board from vibrating or moving in the direction perpendicular to the moving direction.

A first board slit through which the guide board of the first air flow converter passes may be formed on the first wall of the first tower, a second board slit through which the guide board of the second air flow converter passes may be formed on the second wall of the second tower, when the guide board of the first air flow converter is disposed inside the first tower, the end portion of the guide board of the first air flow converter may be disposed in the first board slit, and when the guide board of the first air flow converter is disposed inside the first tower, the end portion of the guide board of the first air flow converter may be disposed in the first board slit, thereby preventing the wind direction of the air flowing forward along the first wall and the second wall from being changed by the first board slit or the second board slit.

A first board slit through which the guide board of the first air flow converter passes forward of the first outlet may be disposed on the first wall, a second board slit through which the guide board of the second air flow converter passes forward of the second outlet may be disposed on the second wall, and when the guide board of each of the first air flow guider and the second air flow guider protrudes from the first tower or the second tower, a wind direction of air flowing forward through the first outlet or the second outlet may be changed.

According to an embodiment disclosed in the present disclosure, there is one or more of the following aspects. First, it may be possible to provide a direct wind and an indirect wind to a user by including a guide board for controlling a wind direction of air discharged forward through a first outlet and a second outlet. Second, the guide board may be connected to a top and a bottom of the shaft, and has one driving motor, so the disposition of the guide board may be changed. As a result, it may be possible to stably change the disposition of the guide board by using a single motor, even if the simple guide board has a structure in which the guide board is vertically long. The aspects of the present disclosure are not limited to the above-described effects. For example, other aspects that are not described may be obviously understood by those skilled in the art from the claims.

Although the preferred embodiments of the present disclosure have been illustrated and described above, the present disclosure is not limited to the specific embodiments described above, and can be variously modified by those skilled in the art to which the present disclosure pertains without departing from the gist of the present disclosure claimed in the claims, and these modifications should not be understood individually from the technical ideas or prospects of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a lower case that includes an inlet and a fan;

a first tower that extends upward from the lower case and includes a first outlet;

a second tower that extends upward from the lower case, is spaced apart from the first tower, and includes a second outlet;

a blowing space formed between the first and second towers and into which air discharged from the first and second outlets flows; and a first air flow converter provided in the first tower and configured to convert a direction of an airflow of the blowing space, and wherein the first tower comprises:

a first inner wall facing the blowing space and including the first outlet; and a first outer wall opposite to the first inner wall and having an outwardly rounded shape;

wherein the second tower comprises:

a second inner wall facing the blowing space and including the second outlet; and a second outer wall opposite to the second inner wall and having an outwardly rounded shape; and wherein the first air flow converter comprises:

a first motor; and a first guide board that extends in an up-down direction, is provided as a plate shape rounded toward the first outer wall, and slides along an inner surface of the first outer wall such that the first guide board protrudes into the blowing space or is stored inside the first tower.

2. The blower of claim 1, wherein the first outlet is disposed close to a rear end of the first inner wall, and the second outlet is disposed close to a rear end of the second inner wall, and wherein the first guide board is disposed close to a front end of the first or second inner wall.

3. The blower of claim 2, wherein each of the first inner wall and the second inner wall has a convex curvature such that the first inner wall is curved toward the second inner wall and the second inner wall is curved toward the first inner wall.

4. The blower of claim 3, wherein a distance between the first inner wall and the second inner wall is shortest at a center portion of the blowing space in a front-rear direction.

5. The blower of claim 3, wherein each of the first and second outer walls has a convex curvature in a direction opposite to a corresponding one of the first and second inner walls, and the convex curvature of the first and second outer walls is larger than the convex curvature of the first and second inner walls.

6. The blower of claim 2, wherein the first guide board is inclined toward the first outlet such that the first guide board becomes closer to the first outlet from bottom to top.

7. The blower of claim 6, the first air flow converter further comprising:

an upper gear that rotates in engagement with an upper portion of the first guide board;

a lower gear that rotates in engagement with a lower portion of the first guide board; and a shaft that is connected to the upper gear, the lower gear, and the first motor such that the upper gear and the lower gear rotate together, wherein the shaft and a drive shaft of the first motor are inclined to be parallel to the first guide board.

8. The blower of claim 6, the first air flow converter further comprising:

an upper supporter that is fixed inside the first tower and is placed at a rear side of an upper portion of the first guide board;

a lower supporter that is fixed inside the first tower and is placed at a lower side of a lower portion of the first guide board;

an upper guider that is fixed to the upper portion of the first guide board and includes an upper guide rib which is movably engaged with the upper supporter at the rear side of the upper portion of the first guide board; and a lower guider that is fixed to the lower portion of the first guide board and includes a lower guide rib which is movably engaged with the lower supporter at the lower side of the lower portion of the first guide board.

9. The blower of claim 8, wherein the upper guide rib includes an upper horizontal rib extending rearward to be farther from the first guide board, wherein the lower guide rib includes a lower horizontal rib extending forward to be closer to the first guide board, wherein the upper supporter includes an upper support plate supporting a lower surface of the upper horizontal rib, and wherein the lower supporter includes a lower support plate supporting a lower surface of the lower horizontal rib.

10. The blower of claim 9, wherein the upper guide rib includes an upper vertical rib that protrudes upward from a rear end of the upper horizontal rib, wherein the lower guide rib includes a lower vertical rib that protrudes from a front end of the lower horizontal rib in the up-down direction, wherein the upper supporter includes an upper guide groove that is recessed upwardly such that the upper vertical rib is inserted into the upper guide groove, and wherein the lower supporter includes a lower guide groove that is recessed downwardly such that a lower part of the lower vertical rib is inserted into the lower guide groove, and a guide wall that protrudes upwardly to support an upper part of the lower vertical rib.

11. The blower of claim 10, wherein the upper vertical rib is disposed farther from the first guide board than the lower vertical rib is.

12. The blower of claim 10, the first air flow converter further comprising:

a shaft disposed parallel to the first guide board and configured to transfer a driving force of the first motor to the first guide board, and wherein the lower support plate provides a lower shaft groove in which a lower end of the shaft is inserted, and the lower support plate is fan-shaped centered on the lower shaft groove, and wherein the lower guide groove is disposed at a radial end of the lower support plate.

13. The blower of claim 10, wherein the first guide board slides along the inner surface of the first outer wall by rotational movement such that a trajectory of the first guide board is arc-shaped, and wherein the upper guide groove extends in a left-right direction and is arc-shaped such that a curvature of the upper guide groove is concentric with a curvature of the trajectory of the first guide board.

14. The blower of claim 2, wherein the first guide board comprises:

a front surface facing the inner surface of the first outer wall; and a rear surface opposite to the front surface, wherein the first air flow converter further comprises:

a board guider fixed to the rear surface of the first guide board, having a board that receives a driving force of the first motor, and having a guide rib that protrudes; and a supporter fixed inside the first tower, and having a guide groove in which the guide rib is inserted, and wherein the supporter and the first motor are placed at a rear side of the first guide board.

15. The blower of claim 14, wherein when the first guide board protrudes into the blowing space, the first guide board is disposed at an imaginary curved line which has a curvature concentric with a curvature of the first outer wall and connects to the first outer wall.

16. The blower of claim 1, wherein the first outer wall is inclined toward an inner space of the first tower such that the inner space of the first tower becomes narrower from bottom to top, and the second outer wall is inclined toward an inner space of the second tower such that the inner space of the second tower becomes narrower from bottom to top.

17. The blower of claim 16, wherein the lower case is a cylindrical shape of which an inner space is narrower from bottom to top, and the lower case provides a continuous outer surface with the first and second outer walls, and wherein the lower case, the first tower, and the second tower compose a truncated cone shape.

18. The blower of claim 16, wherein the first guide board is inclined in a direction that an adjacent portion of the first outer wall is inclined to.

19. The blower of claim 16, wherein the first inner wall and the second inner wall extend in the up-down direction and are parallel to each other.

20. The blower of claim 1, wherein the first outer wall and the second outer wall have centers of curvature located in the blowing space, and a center of curvature of the first guide board is located in the blowing space.

21. The blower of claim 1, wherein the first guide board slides along the inner surface of the first outer wall by rotational movement.

22. The blower of claim 21, wherein a trajectory of the first guide board is arc-shaped.

23. The blower of claim 22, wherein a curvature of the trajectory of the first guide board is the same as a curvature of a shape of the first guide board.

24. The blower of claim 22, wherein a curvature of the trajectory of the first guide board is concentric with a curvature of a circle defined by a shape of the first outer wall.

25. The blower of claim 1, wherein the first guide board slides along the inner surface of the first outer wall by linear movement.

26. The blower of claim 1, wherein front, rear, and upper sides of the blowing space are opened, and wherein the first guide board protrudes into the blowing space to close at least a portion of the front side of the blowing space and guides the airflow of the blowing space to the upper side.

27. The blower of claim 26, further comprising a second air flow converter provided in the second tower and configured to convert the direction of the airflow of the blowing space, wherein the second air flow converter comprises:

a second guide board that extends in the up-down direction, is provided as a plate shape rounded toward the second outer wall, and slides along an inner surface of the second outer wall such that the second guide board protrudes into the blowing space or is stored inside the second tower, and wherein the first and second guide boards protrude to collectively cover the front side of the blowing space.

28. The blower of claim 1, wherein the first tower includes a first heater extending in the up-down direction, and the second tower includes a second heater extending in the up-down direction, and wherein an upper end of the first heater is located lower than an upper end of the first guide board, and a lower end of the first heater is located higher than a lower end of the first guide board.

29. The blower of claim 1, wherein the first tower includes a first heater extending in the up-down direction, the second tower includes a second heater extending in the up-down direction, and wherein each of the first and second heaters tilted such that an upper end thereof is located ahead of a lower end thereof.

30. The blower of claim 1, wherein the first air flow converter further comprises:

a board guider fixed to the first guide board by a pair of board mounters spaced apart in the up-down direction, having a board gear that receives a driving force from the first motor, and having a guide rib that protrudes; and a supporter fixed inside the first tower, and having a guide groove in which the guide rib is inserted, and wherein the board gear is disposed between the pair of board mounters.

31. The blower of claim 30, wherein the guide rib is disposed between the pair of board mounters and is disposed closer to an end portion of the first guide board in the up-down direction than the board gear.

32. The blower of claim 30, wherein the first guide board slides along the inner surface of the first outer wall by rotational movement such that a trajectory of the first guide board is arc-shaped, and wherein the board gear is an arc-shaped rack gear having a curvature that is concentric with a curvature of the trajectory of the first guide board.

33. The blower of claim 32, wherein the board gear extends along the trajectory of the first guide board.

* * * * *